US011064817B2

(12) United States Patent
Turner et al.

(10) Patent No.: US 11,064,817 B2
(45) Date of Patent: Jul. 20, 2021

(54) MERCHANDISER AND METHODS RELATING TO SAME

(71) Applicant: Retail Space Solutions LLC, Milwaukee, WI (US)

(72) Inventors: Christopher J. Turner, Pewaukee, WI (US); Craig A. Fluegge, Menomonee Falls, WI (US)

(73) Assignee: Retail Space Solutions LLC, Milwaukee, WI (US)

( * ) Notice: Subject to any disclaimer, the term of this patent is extended or adjusted under 35 U.S.C. 154(b) by 122 days.

(21) Appl. No.: 15/747,052

(22) PCT Filed: Jul. 21, 2016

(86) PCT No.: PCT/US2016/043354

§ 371 (c)(1),
(2) Date: Jan. 23, 2018

(87) PCT Pub. No.: WO2017/015466

PCT Pub. Date: Jan. 26, 2017

(65) Prior Publication Data

US 2018/0360233 A1 Dec. 20, 2018

Related U.S. Application Data

(60) Provisional application No. 62/195,847, filed on Jul. 23, 2015, provisional application No. 62/247,744, filed on Oct. 28, 2015.

(51) Int. Cl.
*A47F 1/12* (2006.01)
*A47F 5/00* (2006.01)

(52) U.S. Cl.
CPC ..... *A47F 1/126* (2013.01); *A47F 1/125* (2013.01); *A47F 5/0093* (2013.01)

(58) Field of Classification Search
CPC ..... A47F 1/126; A47F 5/0093; A47F 5/005; A47F 1/125; A47F 1/04; A47F 5/0025;
(Continued)

(56) References Cited

U.S. PATENT DOCUMENTS 935,560 A * 9/1909 Stone ..... A47F 5/005 211/184
1,049,726 A * 1/1913 Johnson ..... D06F 57/08 211/195

(Continued)

FOREIGN PATENT DOCUMENTS

EP 2767192 8/2014
GB 2290077 12/1995

(Continued)

OTHER PUBLICATIONS

International Search Report and Written Opinion issued in corresponding PCT/US2016/043354, dated Dec. 8, 2016.

*Primary Examiner* — Hiwot E Tefera
(74) *Attorney, Agent, or Firm* — Andrus Intellectual Property Law, LLP

(57) ABSTRACT

A product display tray is provided including one or more arms including engagement members. The product display tray can also include a base having one or more tracks receiving the one or more arms, wherein the base is slidable along the one or more arms from a first position to a second position. The product display tray can also include a handle. The product display tray can also include a latch, wherein the latch is operably connected to the handle, wherein the latch has an engaged position and a disengaged position, and wherein the latch is in the engaged position when the base is in the first position and the base is operable to enter the second position when the latch is in the disengaged position.

20 Claims, 30 Drawing Sheets

(58) Field of Classification Search
CPC .. A47F 1/12; A47F 5/0068; A47F 3/14; A47F 5/0087; A47F 5/083; A47B 57/585; A47B 87/0269; A47B 65/15; A47B 57/58; A47B 96/025; A47B 96/027; A47B 57/42; A47B 96/07
USPC ..... 211/59.2–59.4, 184, 42, 43
See application file for complete search history.

(56) References Cited

U.S. PATENT DOCUMENTS 1,702,987 A 2/1929 Wilson
2,919,814 A 1/1960 Berkowitz
2,934,212 A 4/1960 Jacobson
3,120,894 A * 2/1964 Conley ..... A47B 57/585 211/43
3,161,295 A 12/1964 Taylor
3,452,899 A 7/1969 Libberton
3,889,816 A * 6/1975 Herryman ..... A47B 65/20 211/43
4,022,363 A 5/1977 Eliassen
4,099,624 A * 7/1978 McKearin ..... A47B 65/00 211/42
4,130,203 A 12/1978 Russell
4,310,097 A 1/1982 Merl
4,318,485 A 3/1982 Clement
4,367,818 A 1/1983 Suttles
4,401,221 A 8/1983 Suttles
4,423,816 A 1/1984 Suttles
D290,670 S 7/1987 Nathan et al.
D290,790 S 7/1987 Nathan et al.
4,705,175 A 11/1987 Howard
4,726,236 A 2/1988 Wada
4,730,741 A 3/1988 Jackle
4,836,390 A 6/1989 Polvere
D305,586 S 1/1990 Wombacher
4,907,707 A 3/1990 Crum
5,012,936 A * 5/1991 Crum ..... A47F 1/126 206/556
5,123,546 A 6/1992 Crum
5,366,099 A 11/1994 Schmid
5,413,229 A 5/1995 Zuberbuhler
5,450,969 A 9/1995 Johnson
5,562,217 A 10/1996 Salveson
D376,060 S 12/1996 Cohen
5,586,665 A 12/1996 Brousseau
5,613,621 A 3/1997 Gervasi
5,634,564 A 6/1997 Spamer
D382,428 S 8/1997 Meier
5,665,304 A * 9/1997 Heinen ..... A47F 1/126 108/110
5,671,851 A 9/1997 Johnson
5,673,801 A * 10/1997 Markson ..... A47F 1/126 211/184
5,695,075 A 12/1997 Flum
5,706,956 A 1/1998 Headrick
5,706,958 A 1/1998 Spamer
D390,052 S 2/1998 Wolff
5,755,341 A 5/1998 Spamer
5,779,068 A 7/1998 Whiten
D401,436 S 11/1998 Jay
5,855,281 A 1/1999 Rabas
5,855,283 A * 1/1999 Johnson ..... A47F 1/126 211/103
5,878,894 A 3/1999 Robertson
5,957,327 A 9/1999 Whiten
5,970,887 A * 10/1999 Hardy ..... A47B 46/00 108/108
6,041,720 A * 3/2000 Hardy ..... A47B 96/02 108/60
6,059,125 A 5/2000 Parham
6,142,317 A 11/2000 Merl
6,155,438 A 12/2000 Close
6,164,462 A * 12/2000 Mumford ..... A47F 5/0093 108/102
6,193,067 B1 2/2001 McMahan
6,227,386 B1 5/2001 Close
6,375,015 B1 4/2002 Wingate
6,484,891 B2 11/2002 Burke
6,622,874 B1 * 9/2003 Hawkinson ..... A47F 1/126 211/175
D480,231 S 10/2003 Valiulis
6,640,983 B2 11/2003 Miller, Jr.
6,719,152 B1 4/2004 Nagel
6,745,906 B1 6/2004 Nagel
6,769,552 B1 8/2004 Thalenfeld
6,772,888 B2 8/2004 Burke
D496,179 S 9/2004 Sjoberg
6,799,523 B1 * 10/2004 Cunha ..... A47F 5/0093 108/108
D500,091 S 12/2004 Sjoberg
6,866,155 B2 3/2005 Nagel
6,866,156 B2 3/2005 Nagel
6,886,699 B2 * 5/2005 Johnson ..... A47F 1/126 108/61
6,886,700 B2 5/2005 Nagel
6,889,854 B2 5/2005 Burke
6,889,855 B2 5/2005 Nagel
6,923,330 B1 8/2005 Nagel
6,964,235 B2 11/2005 Hardy
7,028,852 B2 4/2006 Johnson
7,032,761 B2 4/2006 Nagel
7,168,579 B2 * 1/2007 Richter ..... A47F 1/126 211/59.3
7,201,281 B1 * 4/2007 Welker ..... A47F 1/126 211/59.3
7,246,711 B1 * 7/2007 Metcalf ..... A47B 45/00 211/106.01
7,258,317 B1 * 8/2007 Nagel ..... A47B 96/025 108/108
D552,877 S 10/2007 Trulaske, Sr.
D565,322 S 4/2008 Mason
7,451,881 B2 11/2008 Hardy
7,506,769 B2 3/2009 Howerton
7,621,409 B2 11/2009 Hardy
7,690,519 B2 4/2010 Kahl
7,703,614 B2 4/2010 Schneider
7,712,851 B2 5/2010 Huang
7,815,267 B1 10/2010 Frousiakis
7,823,734 B2 11/2010 Hardy
7,854,333 B2 12/2010 Kottke
7,854,334 B2 12/2010 Nagel
7,866,772 B1 1/2011 Chen
7,967,399 B1 6/2011 Baiza
D649,681 S 11/2011 Trzesniowski
8,047,385 B2 11/2011 Hardy
8,096,427 B2 1/2012 Hardy
8,113,360 B2 2/2012 Olson
8,113,601 B2 2/2012 Hardy
8,136,682 B2 3/2012 Hardy
8,186,520 B2 5/2012 Schneider
8,210,363 B2 7/2012 Hardy
8,210,367 B2 7/2012 Nagel
8,235,222 B2 8/2012 Hardy
8,235,226 B2 8/2012 Crawbuck
8,235,227 B2 8/2012 Hardy
8,267,261 B2 9/2012 Vanderhoek
D668,945 S 10/2012 Fernandez
8,302,784 B2 11/2012 Nagel
8,312,999 B2 11/2012 Hardy
D674,219 S 1/2013 Kim
D677,502 S 3/2013 Ryan
8,413,823 B2 4/2013 Hardy
8,413,826 B2 4/2013 Schneider
8,443,988 B2 5/2013 Niederhuefner
8,453,850 B2 6/2013 Hardy
8,453,851 B2 * 6/2013 Ciesick ..... A47F 1/126 211/59.3
8,468,844 B2 6/2013 Nagel
8,496,126 B2 7/2013 Mueller
8,561,818 B2 10/2013 Nagel
8,602,226 B1 * 12/2013 Chen ..... A47F 1/00 211/59.4

(56) References Cited

U.S. PATENT DOCUMENTS

| | | | | |
|---|---|---|---|---|
| 8,627,965 | B2 | 1/2014 | Hardy | |
| 8,739,984 | B2 | 6/2014 | Hardy | |
| 8,820,545 | B2 | 9/2014 | Kologe | |
| D716,090 | S | 10/2014 | Schepens | |
| 8,905,246 | B2 | 12/2014 | Lynch | |
| 8,997,997 | B2 | 4/2015 | Close | |
| 9,038,852 | B2 | 5/2015 | Yasaka | |
| 9,044,089 | B1 * | 6/2015 | Sandhu | A47F 5/0093 |
| 9,055,828 | B2 | 6/2015 | Burchell | |
| 9,089,214 | B2 | 7/2015 | Kelly | |
| 9,095,229 | B2 | 8/2015 | Attree | |
| D767,311 | S | 9/2016 | Hrovat | |
| D784,747 | S | 4/2017 | Jackson | |
| 9,615,675 | B2 | 4/2017 | Camello | |
| D786,588 | S | 5/2017 | Knapp | |
| 9,706,858 | B2 | 7/2017 | Johnson | |
| 2003/0217980 | A1 | 11/2003 | Johnson | |
| 2004/0084392 | A1 | 5/2004 | Richter | |
| 2004/0245197 | A1 * | 12/2004 | McElvaney | A47F 1/125 211/184 |
| 2005/0150847 | A1 * | 7/2005 | Hawkinson | A47F 5/005 211/59.2 |
| 2005/0204966 | A1 | 9/2005 | Bienick | |
| 2005/0258113 | A1 | 11/2005 | Close | |
| 2006/0076301 | A1 | 4/2006 | Caterinacci | |
| 2006/0186065 | A1 | 8/2006 | Ciesick | |
| 2007/0068885 | A1 | 3/2007 | Busto | |
| 2007/0080175 | A1 | 4/2007 | Petersen | |
| 2007/0256992 | A1 | 11/2007 | Olson | |
| 2008/0035589 | A1 | 2/2008 | Rasmussen | |
| 2008/0121146 | A1 | 5/2008 | Burns | |
| 2008/0283477 | A1 | 11/2008 | Wamsley | |
| 2009/0039040 | A1 | 2/2009 | Johnson | |
| 2009/0107938 | A1 * | 4/2009 | Miller, Jr. | A47F 3/0404 211/133.6 |
| 2009/0223916 | A1 | 9/2009 | Kahl | |
| 2010/0032392 | A1 | 2/2010 | Camello | |
| 2010/0107670 | A1 | 5/2010 | Kottke | |
| 2010/0176075 | A1 | 7/2010 | Nagel | |
| 2011/0215061 | A1 | 9/2011 | Niederhuefner | |
| 2012/0055892 | A1 | 3/2012 | Hardy | |
| 2012/0255924 | A1 | 10/2012 | Kologe | |
| 2013/0193095 | A1 | 8/2013 | Nagel | |
| 2013/0193096 | A1 | 8/2013 | Hardy | |
| 2013/0206713 | A1 * | 8/2013 | Hardy | A47F 1/126 211/59.3 |
| 2013/0240467 | A1 | 9/2013 | Ciesick | |
| 2013/0327730 | A1 | 12/2013 | Hardy | |
| 2014/0034592 | A1 | 2/2014 | Hardy | |
| 2014/0117818 | A1 | 5/2014 | Dipaolo | |
| 2014/0175034 | A1 | 6/2014 | Hardy | |
| 2014/0190913 | A1 | 7/2014 | Hardy | |
| 2014/0190917 | A1 * | 7/2014 | Szpak | A47F 1/04 211/134 |
| 2014/0284290 | A1 | 9/2014 | Hardy | |
| 2014/0299560 | A1 * | 10/2014 | Kim | A47F 1/126 211/59.2 |
| 2014/0305889 | A1 * | 10/2014 | Vogler | A47F 1/125 211/59.3 |
| 2014/0319086 | A1 | 10/2014 | Sosso | |
| 2014/0360953 | A1 | 12/2014 | Pichel | |
| 2015/0028680 | A1 | 1/2015 | Zeuch | |
| 2015/0374120 | A1 | 12/2015 | Hardy | |
| 2016/0000235 | A1 | 1/2016 | Hardy | |
| 2017/0273477 | A1 * | 9/2017 | Mercier | A47F 1/126 |
| 2018/0103773 | A1 * | 4/2018 | Chenoweth | F21V 21/088 |

FOREIGN PATENT DOCUMENTS

| | | |
|---|---|---|
| GB | 2392667 | 3/2004 |
| GB | 2351073 | 8/2011 |
| WO | 2014200759 | 12/2014 |

* cited by examiner

MERCHANDISER AND METHODS RELATING TO SAME

CROSS-REFERENCE TO RELATED APPLICATIONS

This application is a U.S. national phase application filed under 37 U.S.C. § 371 of International Application No. PCT/US2016/043354, filed Jul. 21, 2016, designating the United States, which claims the benefit of U.S. Provisional Application No. 62/195,847, filed Jul. 23, 2015, and U.S. Provisional Application No. 62/247,744, filed Oct. 28, 2015, which are incorporated herein by reference in their entirety.

FIELD

This invention relates generally to product displays and, more particularly, to merchandisers for front-facing product merchandise for displaying and dispensing product to consumers.

BACKGROUND

Product displays, such as merchandisers, are frequently used in retail environments to display products for sale. It is advantageous for these product displays to be configured to provide consumers easy access to the displayed product as well as facilitate easy reloading by store employees. In addition to ease of use considerations, manufacturers of product displays seek to minimize materials and manufacturing costs associated with the product displays.

One problem with conventional merchandisers is that they typically require intricate structures to make them more user friendly to both end consumers and the retail store clerks or associates who stock and/or restock the merchandisers with displayed product. For example, tray or drawer-type merchandisers that pull out like a drawer to assist store associates in stocking/restocking the merchandiser often require intricate structures that are expensive to manufacture, hard to assemble, and often require operation of inconveniently located release mechanisms to get the tray or drawer to slide out from the display for stocking or restocking purposes.

In addition, conventional tray or drawer type merchandisers require the displayed product to be pressed against pushers during stocking/restocking which can make the merchandiser harder to stock/restock and can cause damage to the product being stocked/restocked depending on how much force is exerted against the product between the person stocking/restocking the displayed product and the pushers of the merchandiser.

While some conventional merchandisers allow flexibility by offering adjustable width side members so that the merchandiser can be used to merchandise products of different size, conventional merchandisers do not allow the merchandiser to be repurposed from displaying one product to two separate products or vice versa.

Accordingly, it has been determined that a need exists for improved product display merchandisers that are not only easy to use, for both consumers and store associates, but also minimally expensive to produce and that offer improved features and functions over conventional merchandisers.

BRIEF DESCRIPTION OF THE FIGURES

Embodiments of the invention are illustrated in the figures of the accompanying drawings in which.

Elements in the figures are illustrated for simplicity and clarity and have not necessarily been drawn to scale or to include all features, options or attachments. For example, the dimensions and/or relative positioning of some of the elements in the figures may be exaggerated relative to other elements to help to improve understanding of various embodiments of the present invention. Also, common but well-understood elements that are useful or necessary in a commercially feasible embodiment are often not depicted in order to facilitate a less obstructed view of these various embodiments of the present invention. Certain actions and/or steps may be described or depicted in a particular order of occurrence while those skilled in the art will understand that such specificity with respect to sequence is not actually required. The terms and expressions used herein have the ordinary technical meaning as is accorded to such terms and expressions by persons skilled in the technical field as set forth above except where different specific meanings have otherwise been set forth herein.

DESCRIPTION OF THE EMBODIMENTS

Introduction

Many variations of product displays are discussed herein and even further are contemplated in view of this disclosure. The product displays discussed herein are configured, and designed, to hold and display product that is for sale and to front face this product so that the next item in the display is moved to the front of the display as the product in front of it is removed from the merchandiser. While many variations of product display are described and contemplated herein, FIGS. 1A-1M, and the associated text, generally depict and describe a first embodiment of a product display, wherein the product display has a baseless design, FIG. 2 and its associated text generally depict a second embodiment, FIG. 3 and its associated text generally depict a third embodiment, FIGS. 4A-P, and the associated text, generally depict and describe a fourth embodiment of a product display merchandiser, wherein the product display merchandiser has an adjustable width and a unique stabilizing structure, FIGS.

Figure 6A:
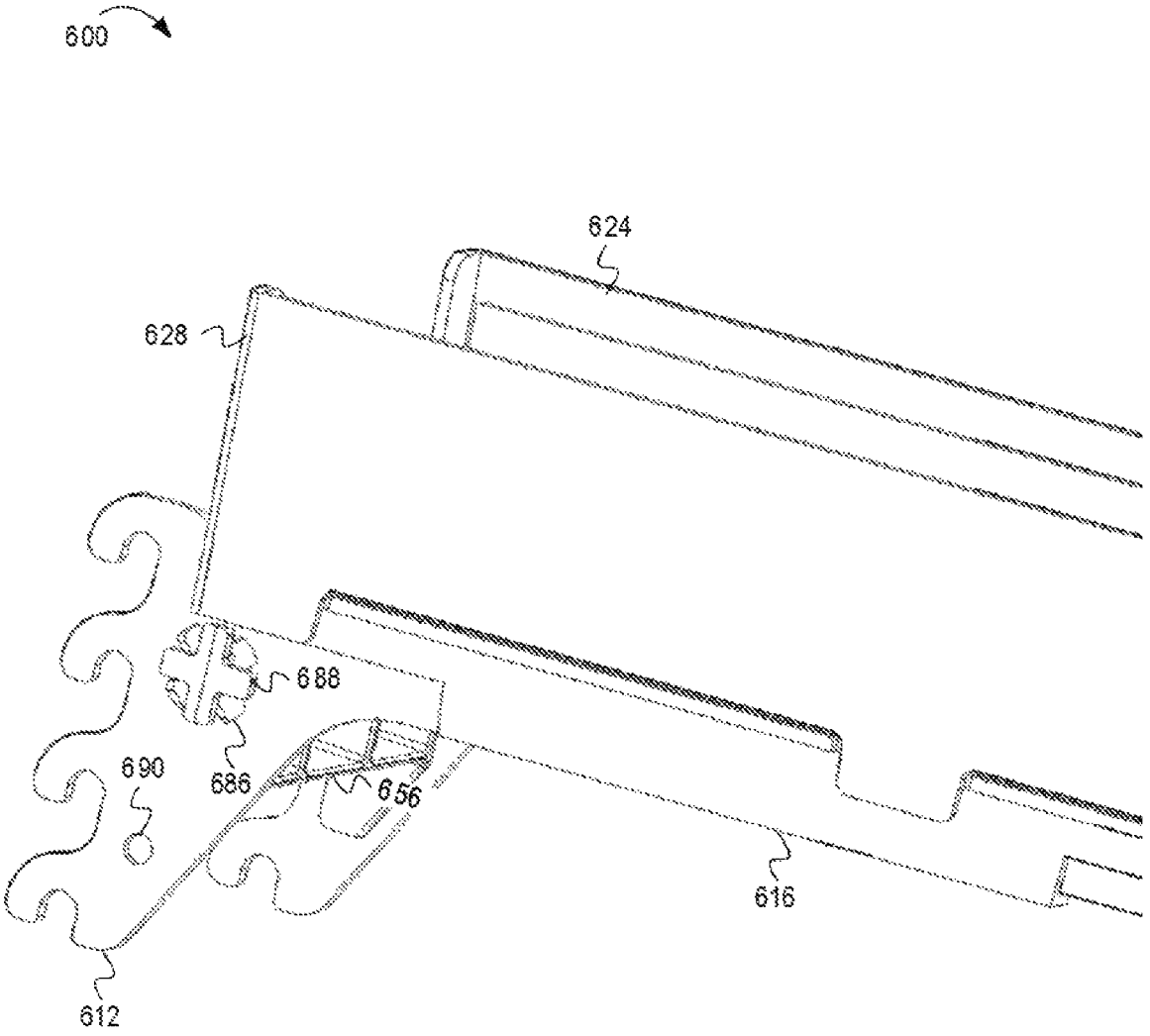
FIG. 6A is a partial perspective view of another product display merchandiser in accordance with embodiments of the inventive subject matter having a mechanism to securely attach a bracket engagement member to a rear stabilizer
Figure 6B:
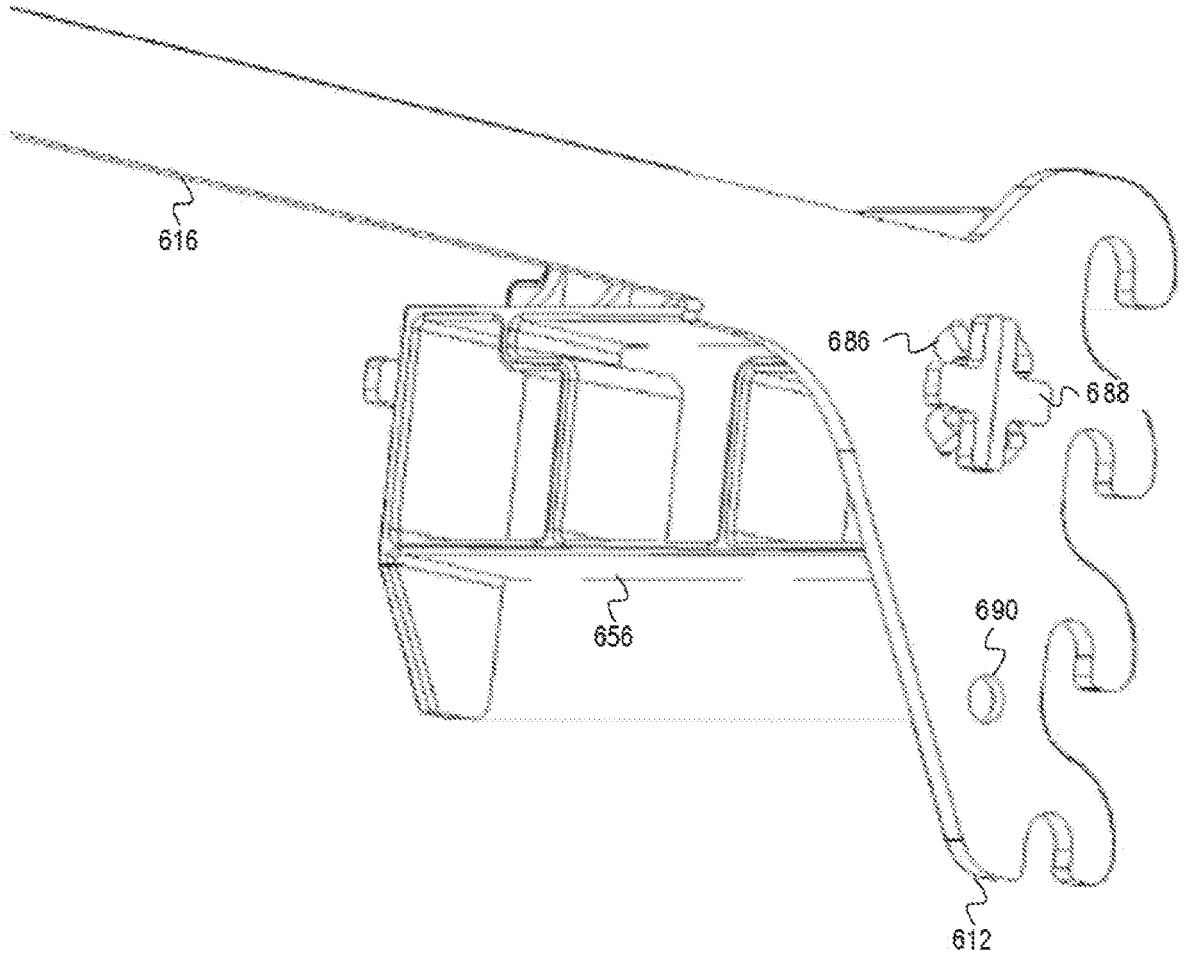
FIG. 6B is an exploded view of the bracket engagement member and rear stabilizer of the product display merchandiser depicted in FIG. 6A.
Figure 6C:
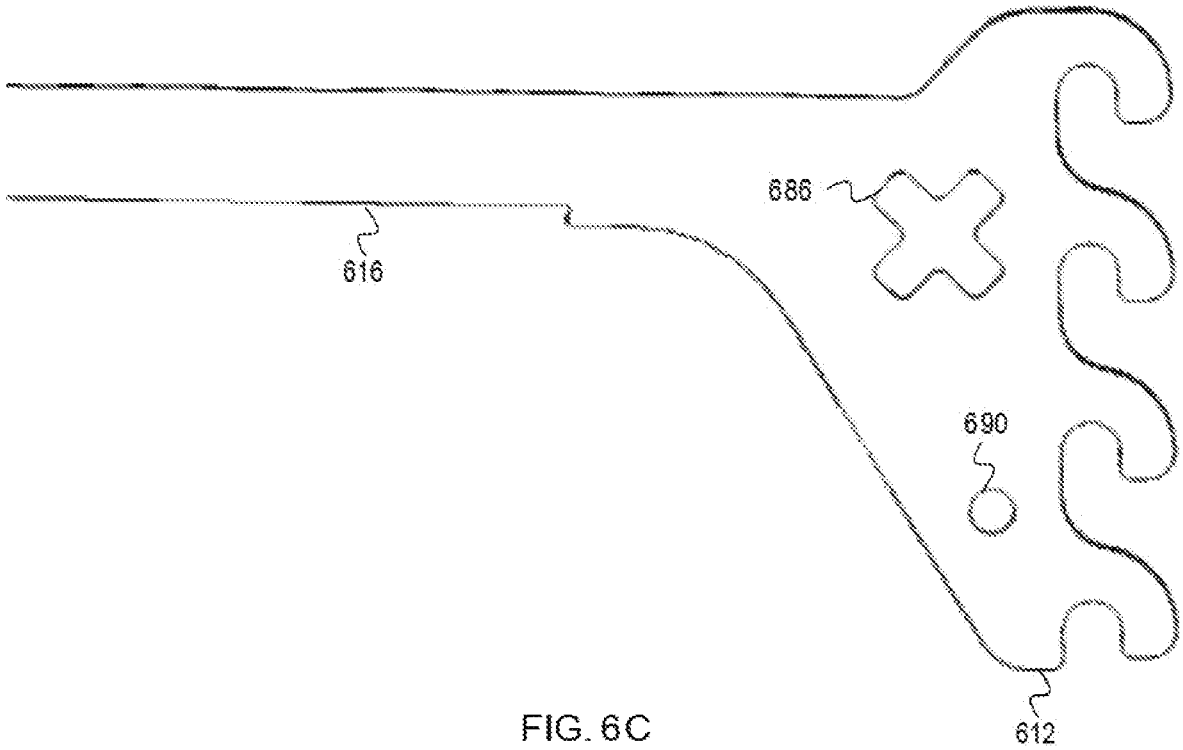
FIG. 6C is an exploded view of the bracket engagement member of the product display merchandiser depicted in FIG. 6A.
Figure 6D:
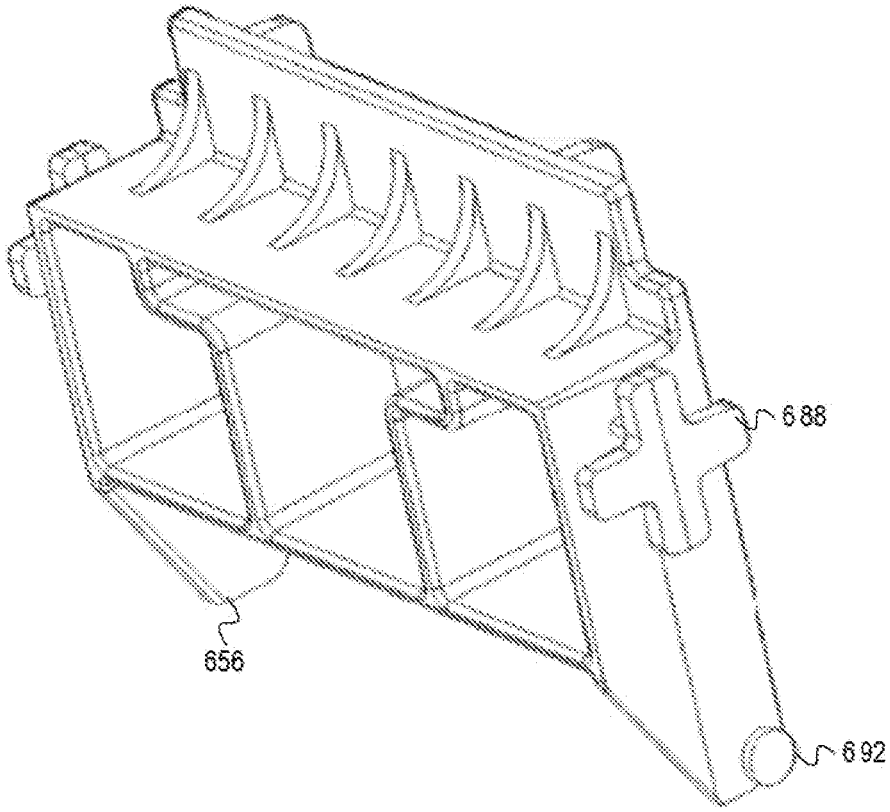
FIG. 6D is an exploded view of the rear stabilizer of the product display merchandiser depicted in FIG. 6A.
Figure 7A:
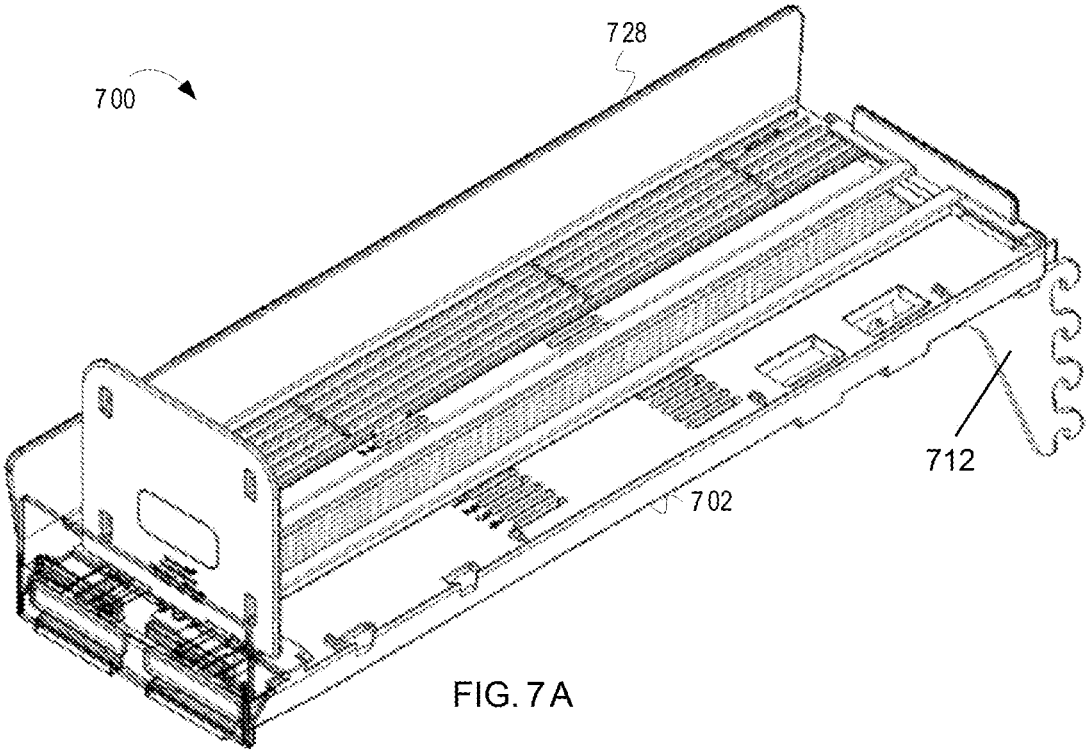
FIG. 7A is a perspective view of another product display merchandiser in accordance with embodiments of the inventive subject matter in which one or more of the product display merchandiser's sidewalls or wings is removable. In some embodiments, such product display merchandisers can be arranged in a linear fashion and a sidewall or wing of an adjacent product display merchandiser can provide support for a product displayed in the product display merchandiser.
Figure 7B:
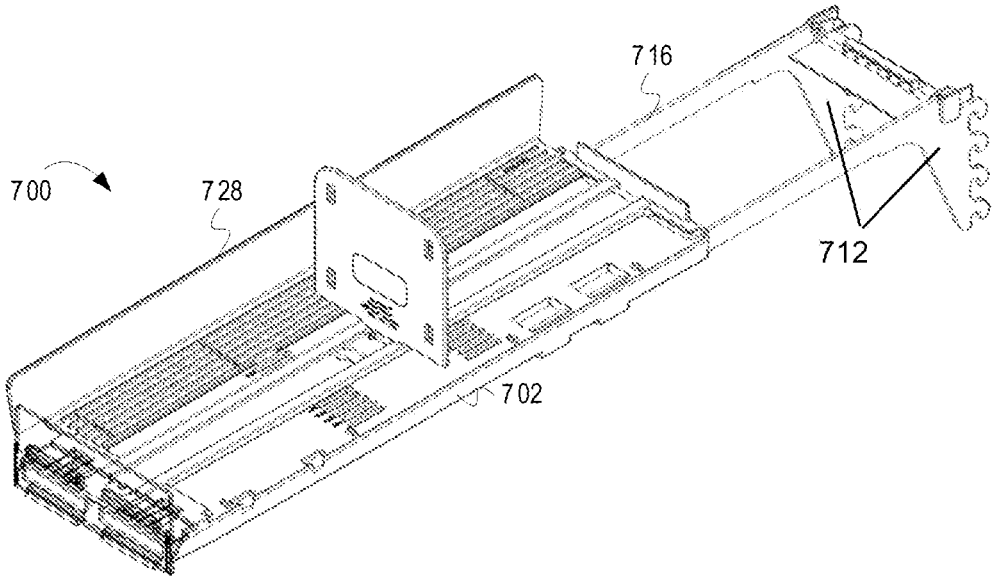
FIG. 7B is a perspective view of the product display merchandiser of FIG. 7A in an extended position in which product can be loaded onto the product display merchandiser from the side.

5A-5E, and the associated text, generally depict and describe a fifth embodiment of a product display merchandiser, wherein the product display merchandiser has an alternate mechanism for adjusting the position of, and securing, the sidewalls or wings and alternate structures for retaining displayed product in the merchandiser when the lens is removed, FIGS. 6A-6B, and the associated text, generally depict and describe a sixth embodiment of a product display merchandiser, wherein the product display merchandiser includes a mechanism to securely attach a bracket engagement member to a rear stabilizer, and FIGS. 7A-7B, and the associated text, generally depict and describe a seventh embodiment of a product display merchandiser, wherein the product display merchandiser includes one or more removable sidewalls or wings for use in unison with one or more other product display merchandisers. Although seven main embodiments are shown, it is understood that features from any one embodiment may be combined with features of other embodiments to come-up with yet further embodiments that are intended to be covered by this disclosure and the following claims despite not being illustrated in a specific drawing figure for same.

First Embodiment

FIGS. 1A-1M illustrate an exemplary embodiment of a product display merchandiser 100, according to some forms of the inventive subject matter. The product display merchandiser 100 includes a tray 102 for holding a product to be displayed. The tray 102 is supported underneath by arms, support members, brackets, or "blades" 116. The arms 116 include bracket engagement members 112 that attach to a rear support member (not shown), such as a vertical upright of a conventional gondola or other store shelving system. The rear support member can be any suitable support member such as conventional grid-type systems, bar type systems, shelves, etc. The product display merchandiser 100 can also have one or more stabilizers positioned in various locations on the product display merchandiser 100. For example, FIG. 1 depicts a stabilizer 114 positioned between the bracket engagement members 112 near the rear of the product display merchandiser 100. In some embodiments, the product display merchandiser 100 can include a stabilizer, in addition to or in lieu of the stabilizer 114, near the front of the product display merchandiser 100. The stabilizer 114 (as well as any other stabilizers) can be sized so as to accommodate trays of multiple dimensions. The product display merchandiser 100 can also include a lens 106 for holding and displaying signage, preventing product from falling out of the tray 102, etc. Such a lens can be formed from any suitable material and in any suitable manner. For example, the lens can be extruded or injection molded plastic. Additionally, in one form, the lens can have perforations which allow for easy snap-off type custom-sizing of the lens.

In use, the product display merchandiser 100 has multiple positions. In one embodiment, the product display merchandiser 100 can have a closed position (best shown in FIGS. 1A-1B, and 1E-1G) for presenting product and an open position (best shown in FIGS. 1H-1K) for restocking product. In the closed position, a majority of the tray 102 is positioned over top of the arms 116. In the open position, the majority of the tray 102 is not positioned over top of the arms 116. The tray 102 travels along the arms 116 from the closed position to the open position in a direction indicated by arrow 126. As depicted in FIG. 1, the tray 102 includes tracks 120 through which the arms 116 extend. The tracks 120 can take any suitable form. For example, the tracks 120 can comprise a number of individual pieces protruding from the tray 102, a continuous or semi-continuous channel running along the tray 102, etc. Additionally the tracks 120 (and/or arms 116) can include ball bearings or any other suitable friction-reducing mechanism.

In some embodiments, the product display merchandiser 100 includes a mechanism that resists movement of the tray 102 between the open and closed positions. Such a mechanism can prevent the tray 102 from moving from the closed position to the open position unintentionally. For example, the product display merchandiser 100 can include a handle 110 (also seen in FIG. 1K) with first engagement members 108. The arms 116 can include second engagement members 104 that are complimentary to the first engagement members 108. Such first engagement members 108 and second engagement members 104 are well-depicted in FIG. 1E. The engagement members are engaged when the tray 102 is in the closed position. Such engagement resists and/or prevents movement of the tray 102 to the open position. In the embodiment depicted in FIG. 1, operation of the handle 110 disengages the engagement members. Such disengagement permits movement of the tray 102 from the closed position to the open position. In one form, the first engagement members 108 disengage from the second engagement members 104 when the handle 110 is displaced in a direction parallel to the movement of the tray 102 across the arms 116 (i.e., in the direction of arrow 126). For example, movement of the handle away from the bracket engagement members 112 disengages the first engagement members 108 from the second engagement members 104. As another example, the handle 110 may displace in a somewhat rotational manner. For example, the handle 110 can be affixed to the tray 102 near a leading edge of the tray (i.e., a portion of the tray opposite the bracket engagement members 112). The handle 110 is operated from an end of the handle 110 opposite a side of the handle 110 affixed to the tray 102. In such embodiments, the handle 110 displaces in a somewhat rotational direction that, for purposes of this specification, can be considered to have a displacement in a direction parallel to the motion of the tray 102 and in a direction perpendicular to the motion of the tray 102.

In one form, the product display merchandiser 100 can include a mechanism that prevents the tray 102 from moving from the open position to the closed position during restocking. For example, the arms 116 and the tracks 120 can include complimentary engagement members that engage when the tray 102 is in the open position. Such engagement members can provide mechanical resistance which must be overcome to move the tray 102 from the open position to the closed position. For example, FIG. 1I depicts a product display merchandiser 100 with arms having an arm engagement member 144 which engages a track engagement member 136. When the tray 102 is in the open position, the track engagement member 136 engages the arm engagement member 144 and provides resistance against the tray 102 moving from the open position to the closed position. In some embodiments, such resistance is physical and is overcome by force being exerted on the tray 102 in a direct of the closed position. In other embodiments, there can be a hook, latch, lever, or other release mechanism which must be utilized to disengage the track engagement members 136 from the arm engagement members 144.

Figure 1A:
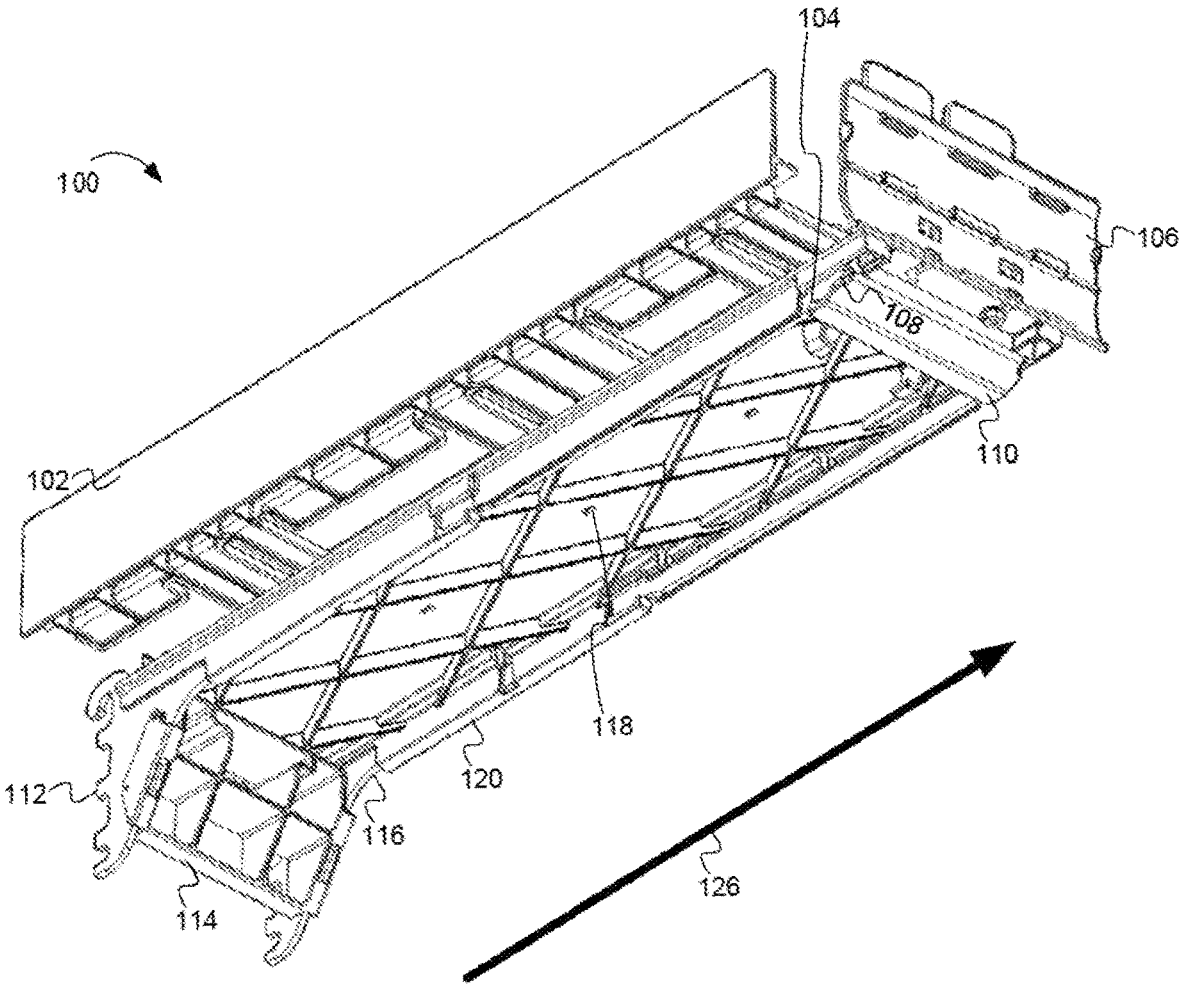
FIG. 1A is a perspective view of a product display merchandiser according to some embodiments of the inventive subject matter taken from below and in front of the merchandiser (or the lower right front of the unit) and illustrating an exemplary baseless design with the left side member or wing in a first, retracted position and the right side member or wing in a second, extended position.
Figure 1B:
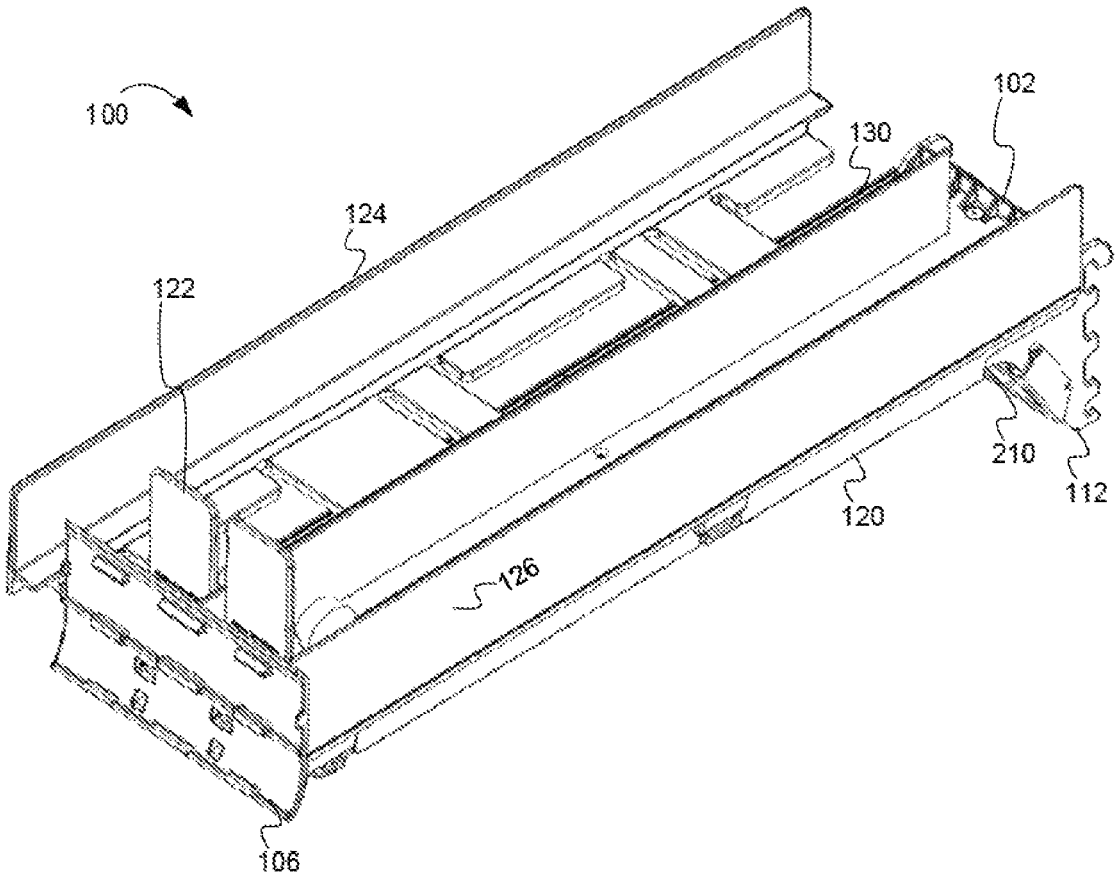
FIG. 1B is an alternate perspective view of the product display merchandiser of FIG. 1, taken from above and in front of the merchandiser (or the upper left front of the unit).
Figure 1C:
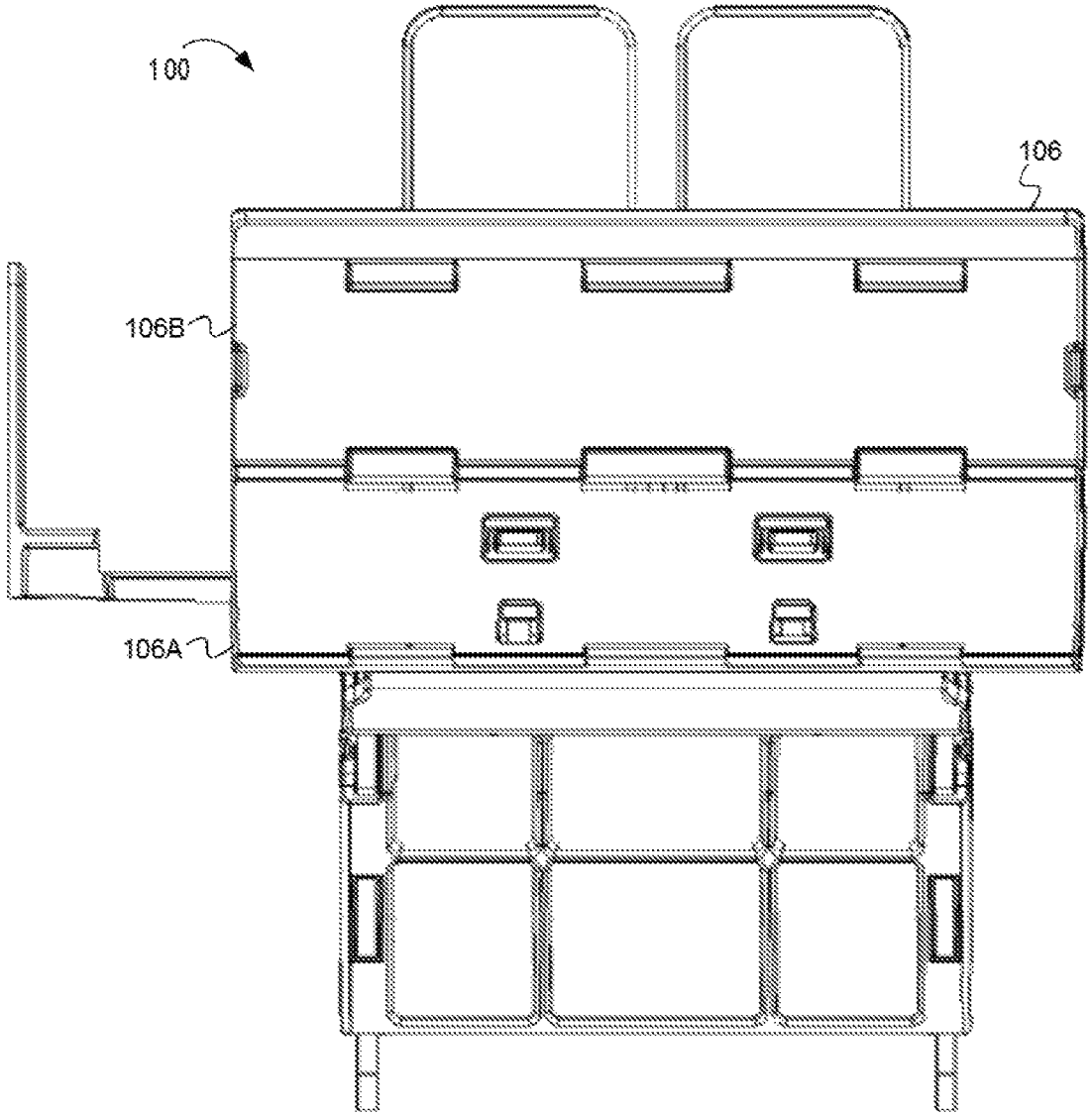
FIGS. 1C, 1D, and 1E are front elevation, rear elevation, and left side elevation views, respectively, of the product display merchandiser of FIGS. 1A-1B, the right side elevation view being a mirror image of the left side elevation view.
Figure 1D:
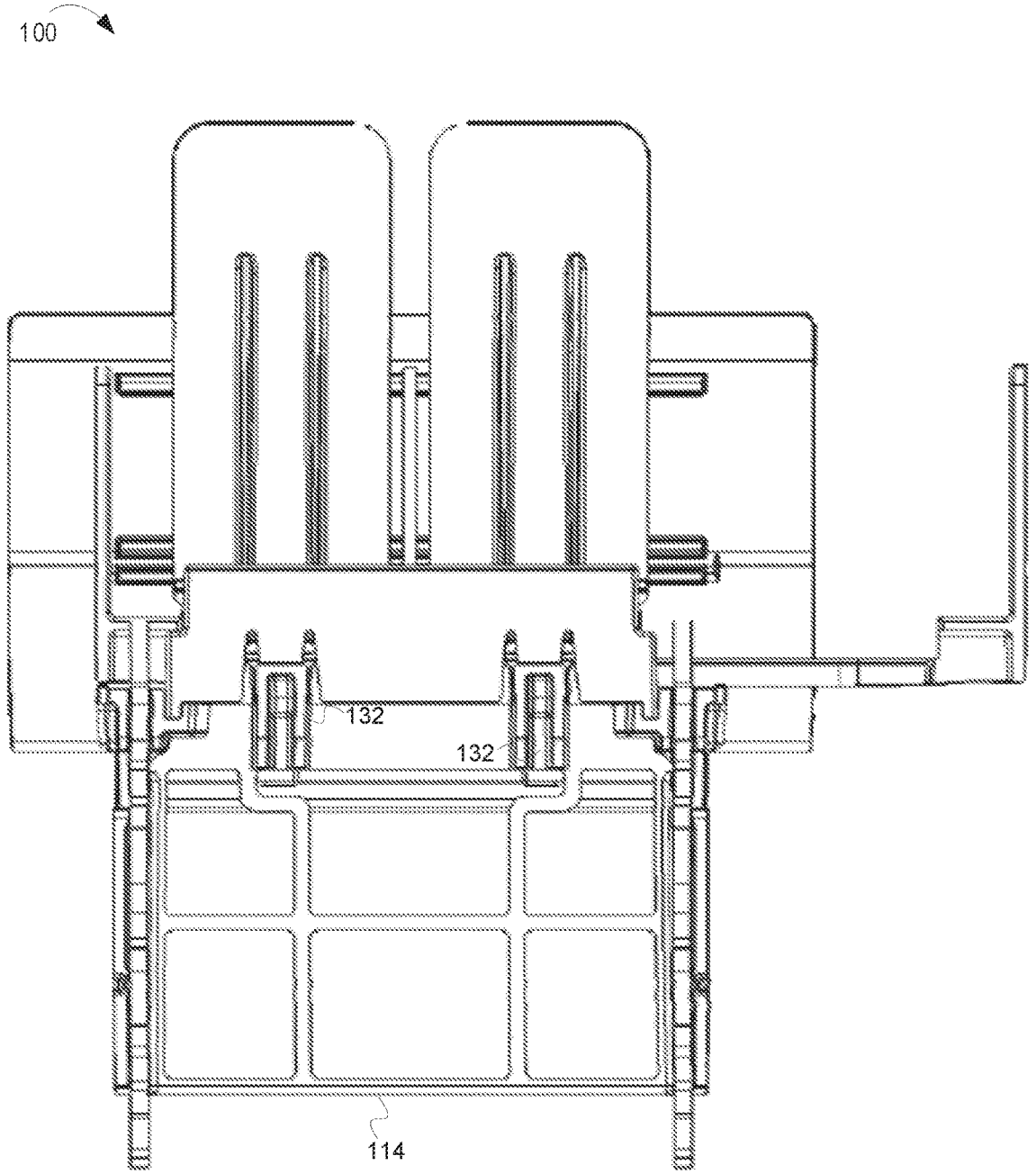
Figure 1E:
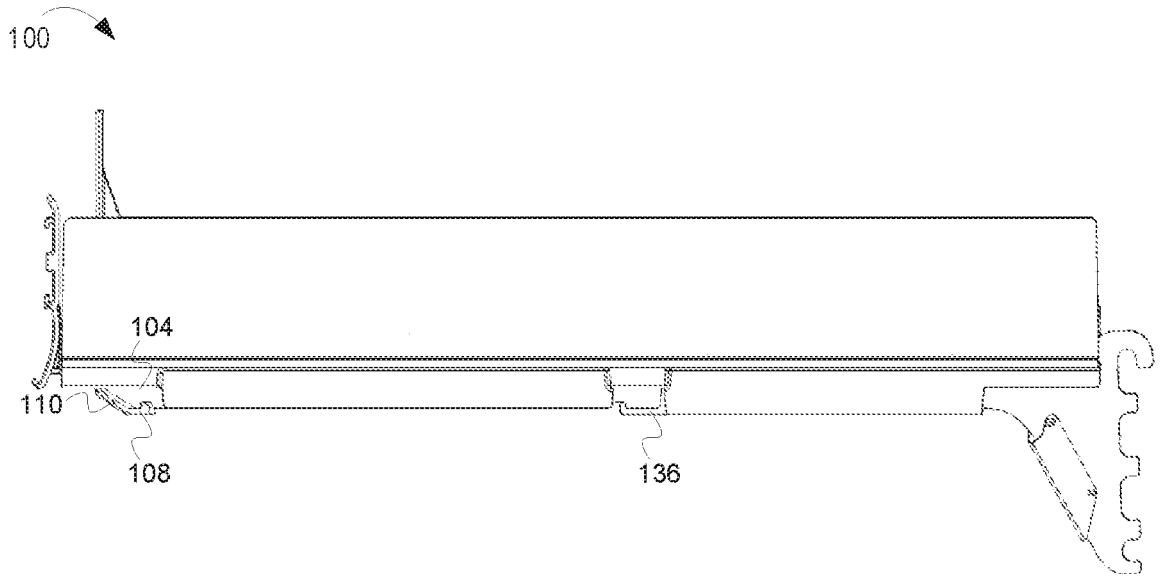

As shown in FIG. 1B the product display merchandiser 100 includes a tray 102 and arms 116. The tray 102 includes tracks 120 through which the arms 116 extend. The tray 102 displaces along the arms 116. The arms 116 can include bracket engagement members 112 configured to mount to a rear support member (not shown). Although FIG. 1B depicts the product display merchandiser 100 configured with bracket engagement members 112 to mount to a rear stabilizer, in some embodiments, the product display merchandiser 100 can be configured to be supported by, attach to, and/or rest on a shelf.

The tray 102 includes a right sidewall 124 and a left sidewall 126 (also referred to as a "side members" or "wings"), as well as a lens 106. In some embodiments, as depicted in FIG. 1B, either (or both) of the right sidewall 124 and the left sidewall 126 are extendable to accommodate product of varying dimensions. The tray 102 of FIG. 1B is depicted with the right sidewall 124 extended. In one form, the right sidewall 124 and left sidewall 126 are incrementally extendable. Additionally, the right sidewall 124 and the left sidewall 126 can be individually extendable or mechanically coupled in such a way that extension of one of the right sidewall 124 and the left sidewall 126 cause extension of the other of the right sidewall 124 and the left sidewall 126.

To further increase compatibility with product of varying dimensions, some embodiments of the product display merchandiser 100 include a removable divider 130. The removable product divider 130 is shown in greater detail in FIG. 1L. The removable divider 130 can attach to the product display merchandiser 100 in any suitable manner. For example, as shown in FIG. 1L, the removable divider 130 can include divider protrusions 148 that mate with slots 118 on the tray 102 (as shown in FIG. 1G), slots which mate with protrusions on the tray 102, a bar that mates with a track on the tray 102, etc. In some embodiments, the removable divider 130 is mountable at multiple locations of varying distance from the right sidewall 124 and the left sidewall 126. When removed, the product display merchandiser 100 preferably includes a storage space for the removable divider 130. FIG. 1M depicts one example by which the removable divider 130 can be stored onboard the product display merchandiser 100. In one form, the tray 102 includes a recess on a bottom side of the tray 102 configured to accommodate and store the removable divider 130. Alternatively or additionally, as depicted in FIG. 1M, the tray 102 can include clips 150 (or other suitable connectors) which hold the removable divider 130 in a stored position on the product display merchandiser 100.

Figure 1F:
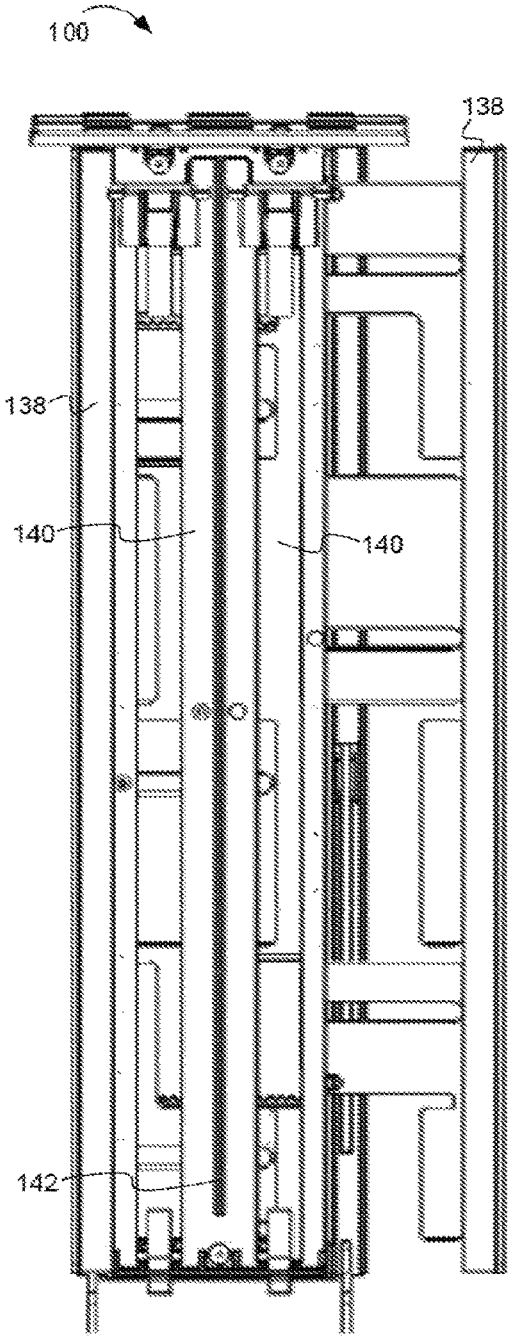
FIGS. 1F and 1G are top and bottom views, respectively, of the product display merchandiser of FIGS. 1A-E illustrating the merchandiser with the tray in a first, retracted position.
Figure 1G:
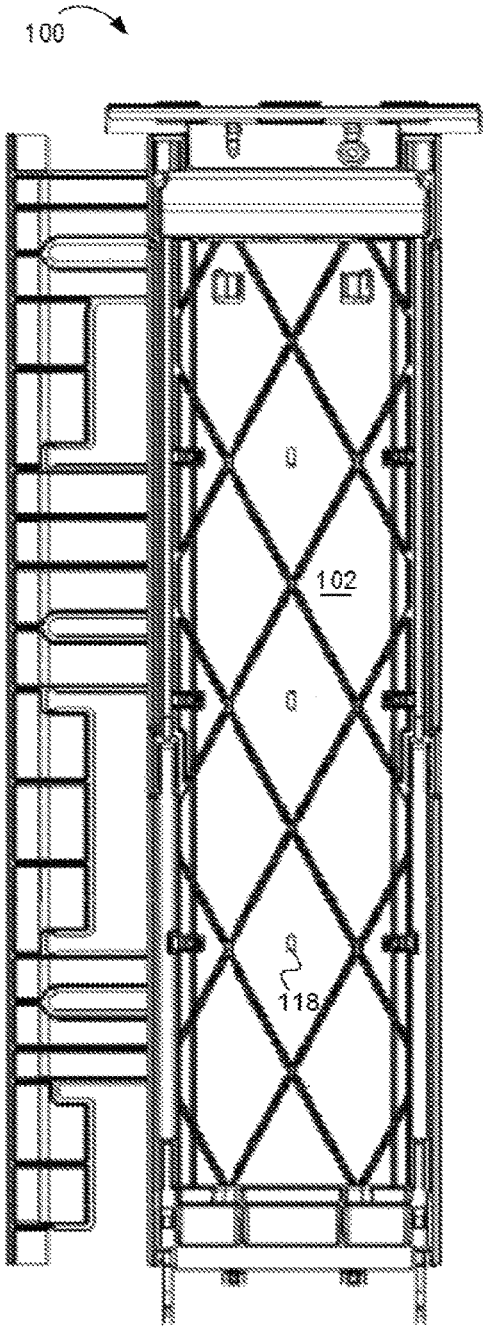

In some embodiments (as depicted in FIG. 1F) a divider 142 (whether or not removable) can take the form of a "T-shape." A horizontal portion of such divider 142 can form a product support surface 140. This product support surface 140 can support a portion of product displayed in the product display merchandiser and a second product support surface 138 located on the sidewall can support another portion of the product displayed in the product display merchandiser 100.

Figure 1H:
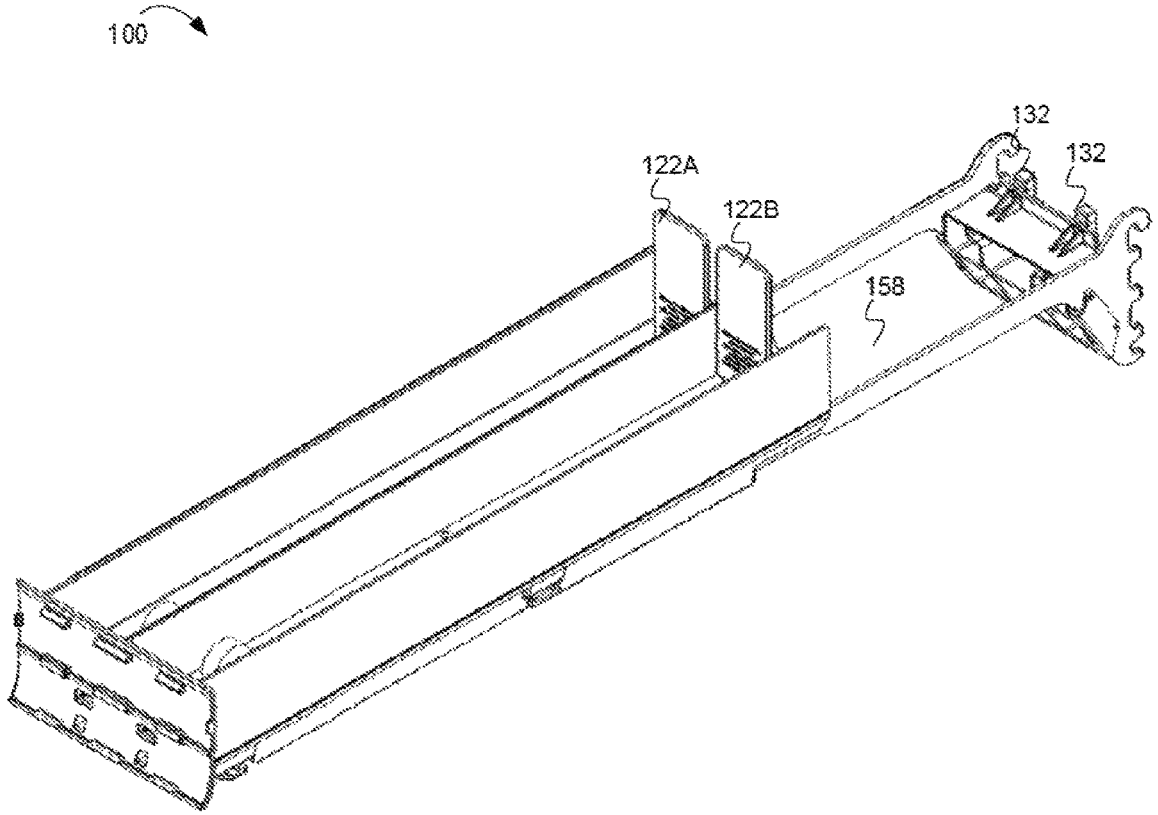
FIGS. 1H, 1I, 1J, and 1K are alternate perspective, left side elevation, top view, and bottom view, respectively, of the product display merchandiser of FIGS. 1A-1G illustrating the merchandiser with the tray in a second, extended position.
Figure 1I:
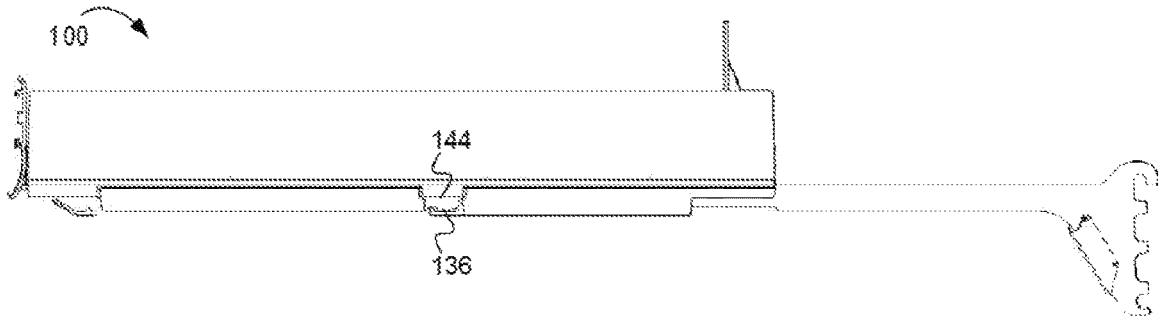
Figure 1J:
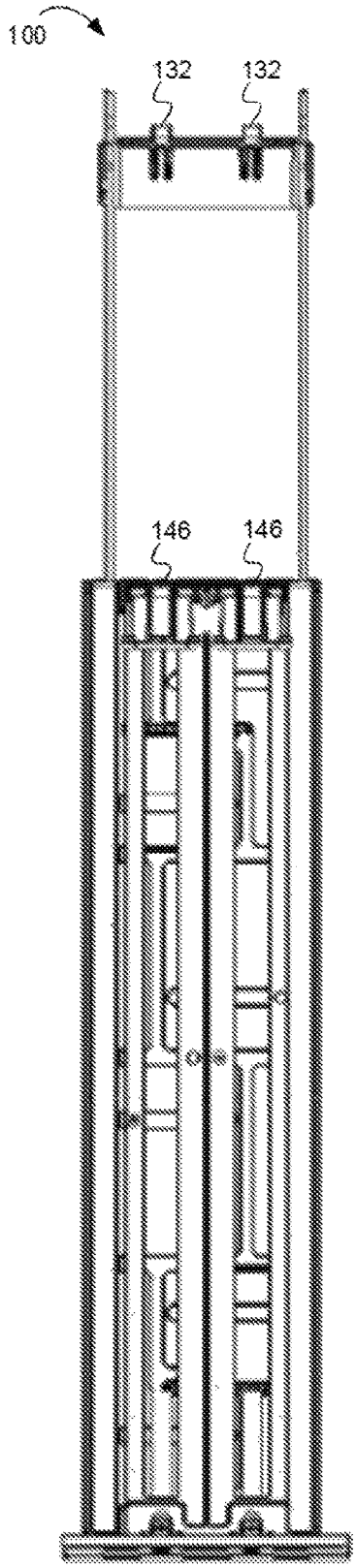
Figure 1K:
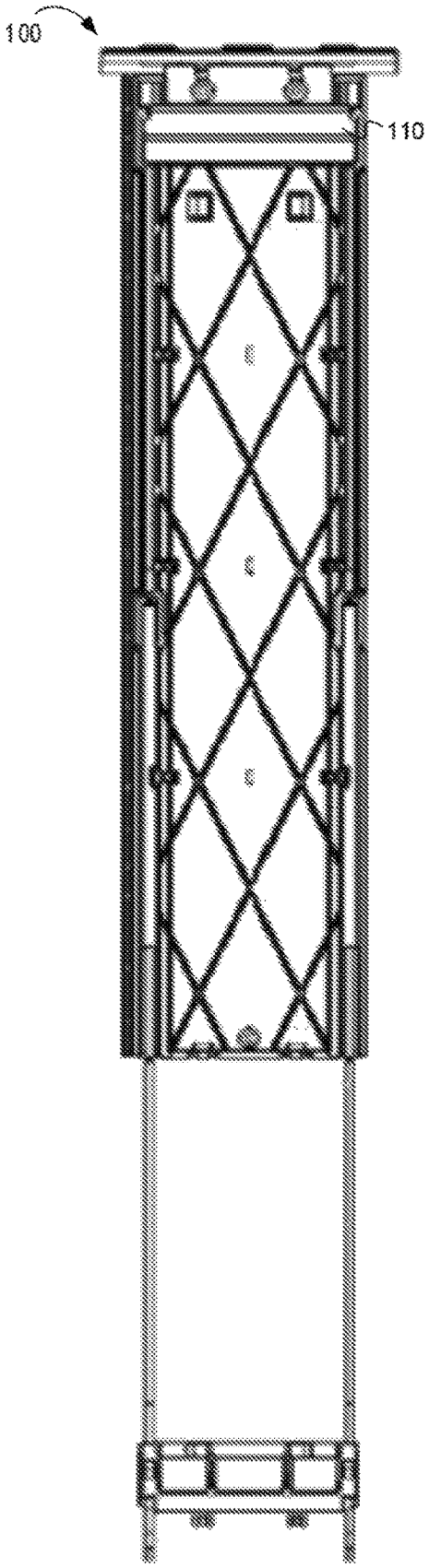
Figure 1L:
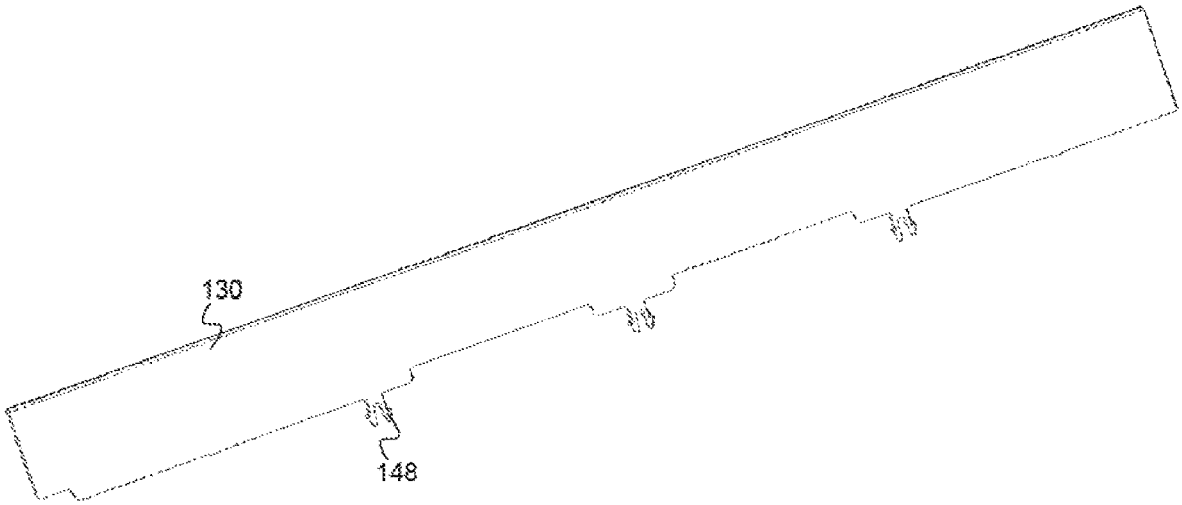
FIGS. 1L and 1M are perspective views of an exemplary removable divider illustrating, in FIG. 1L, one form of mating structure that may be used to mate the divider to the merchandiser unit, and illustrating in FIG. 1M, an exemplary manner in which the removable divider may be stored on the merchandiser for future use.
Figure 1M:
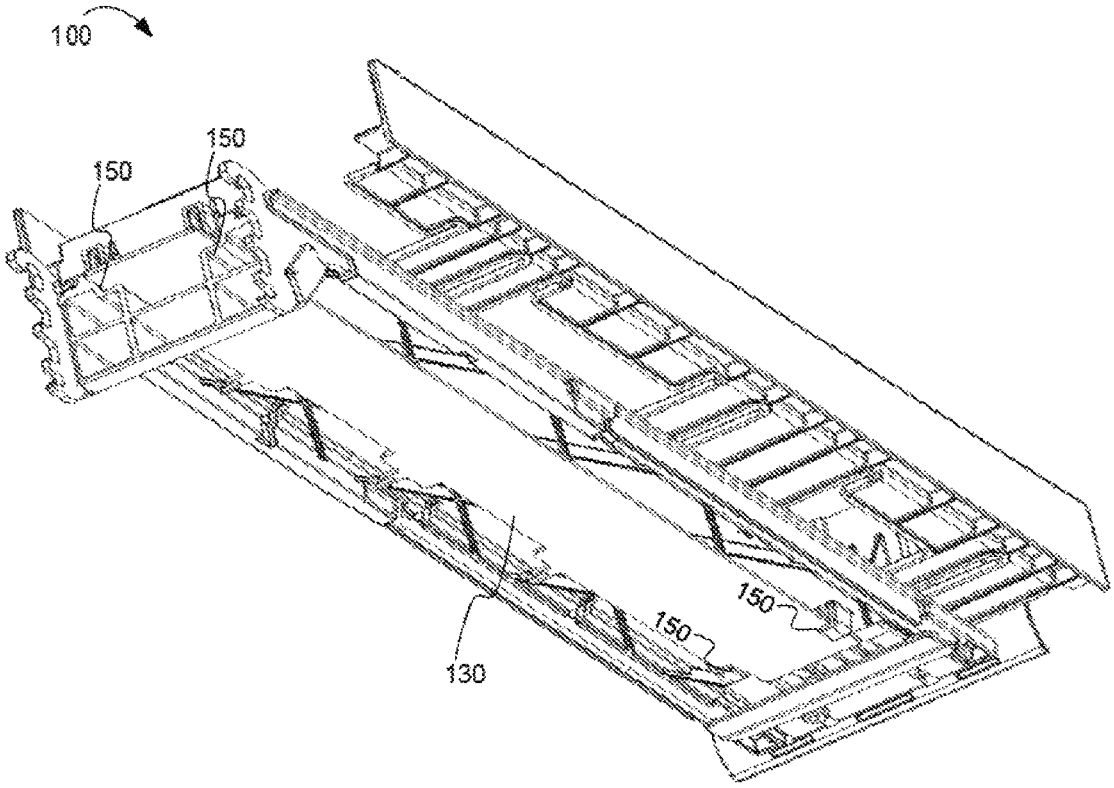

The tray 102 also includes pushers 122. The pushers 122 act to urge product toward the front of the tray 102 (i.e., front face product) making the product easier to access. Although FIG. 1B depicts the tray 102 as including pushers 122, some embodiments of the inventive subject matter do not include pushers 122 to urge product to the front of the tray. For example, instead of pushers 122, the product display merchandiser 100 may be configured to incline, or mount on an incline, in a manner in which gravitational force is employed to urge product to the front of the tray 102. Additionally, although FIG. 1B depicts a product display merchandiser 100 including two pushers 122, some embodiments of the inventive subject matter can include fewer than two pushers or more than two pushers. In embodiments that include pushers 122, the pushers 122 generally comprise a vertical member and a biasing mechanism. The pushers 122 can employ any suitable biasing mechanism, such as a spring, a counterweight, a pulley system, etc. In some embodiments, the pushers 122 include engagement members (e.g., clips, latches, detents, etc.) that engage with complimentary engagement members located on the tray 102, tracks 120, and/or arms 116. The engagement members and the complimentary engagement members act to maintain the pushers 122 in a restocking position when the tray 102 is in an open position. Maintaining the pushers 122 in the restocking position not only makes restocking easier but also helps prevent product from being damaged during the restocking process. In some embodiments, the pushers 122 are maintained at a backmost portion of the tray 102 during restocking. In some embodiments, the engagement members and the complimentary engagement members automatically disengage when the tray 102 is moved from the open position to the closed position. For example, the tray 102, tracks 120, and/or arms 116 can include disengagement members that cause disengagement of the engagement members from the complimentary engagement members. FIGS. 1D, 1H and 1J depict one embodiment of such engagement and disengagement members. FIG. 1J depicts two engagement members 146 coupled to the pushers 122. Although FIG. 1J depicts an embodiment including two pushers 122 and two engagement members 146, it is not necessary that there be a one-to-one correspondence between the pushers 122 and engagement members 146. The two engagement members 146 act (in concert with the complimentary engagement members) to maintain the pushers 122 in the restocking position when the tray 102 is in the open position. FIGS. 1D and 1H depict a product display merchandiser 100 having disengagement members 132. In one form, the disengagement members 132 are linearly aligned with the pushers 122 and correspond one-to-one with the pushers 122, although embodiments exist that do not have either of these features (e.g., one form may have one disengagement member 132 and three pushers 122). The disengagement members 132 act to disengage the engagement members 146 and the complimentary engagement members when the tray 102 is moved from the open position to the closed position. Such action by the disengagement members 132 cause the pushers 122 to be automatically removed from the restocking position. In one form, the disengagement members 132 are protrusions that physically contact one or more of the engagement members and the complimentary engagement members to force disengagement of the engagement members and the complimentary engagement members.

FIG. 1C is a front view of a product display merchandiser 100, according to some embodiments of the inventive subject matter. The product display merchandiser 100 includes a lens 106. As previously discussed, the lens 106 can hold and/or display signage, prevent product from falling out of the tray 100, etc. Such a lens can be formed from any suitable material and in any suitable manner. For example, the lens can be extruded or injection molded plastic. Additionally, in one form, the lens can have perforations which allow for easy snap-off type custom-sizing of the lens. Additionally, the lens 106 can have multiple display sections or channels. For example, the lens 106 may have a first display portion 106A and a second lens portion 106B. Although FIG. 1C depicts lens 106 as having the second display portion 106B arranged above the first display portion 106A, many other configuration exist. For example, the lens 106 may have left and right display sections, or any other combination of two or more display sections.

The remaining figures and text describe alternative embodiments of a product display merchandiser. For purposes of convenience, items that are similar to those discussed above with respect to FIGS. 1A-1M will be referenced using the same last two-digit number but using a first digit corresponding to the figure number simply to distinguish from one another. For example, in FIG. 1, the product tray is referred to generally by reference number 102, while the product tray is referred to as 202, 302, and 402, in FIG. 2, FIG. 3, and FIG. 4, respectively.

Second Embodiment

Figure 2:
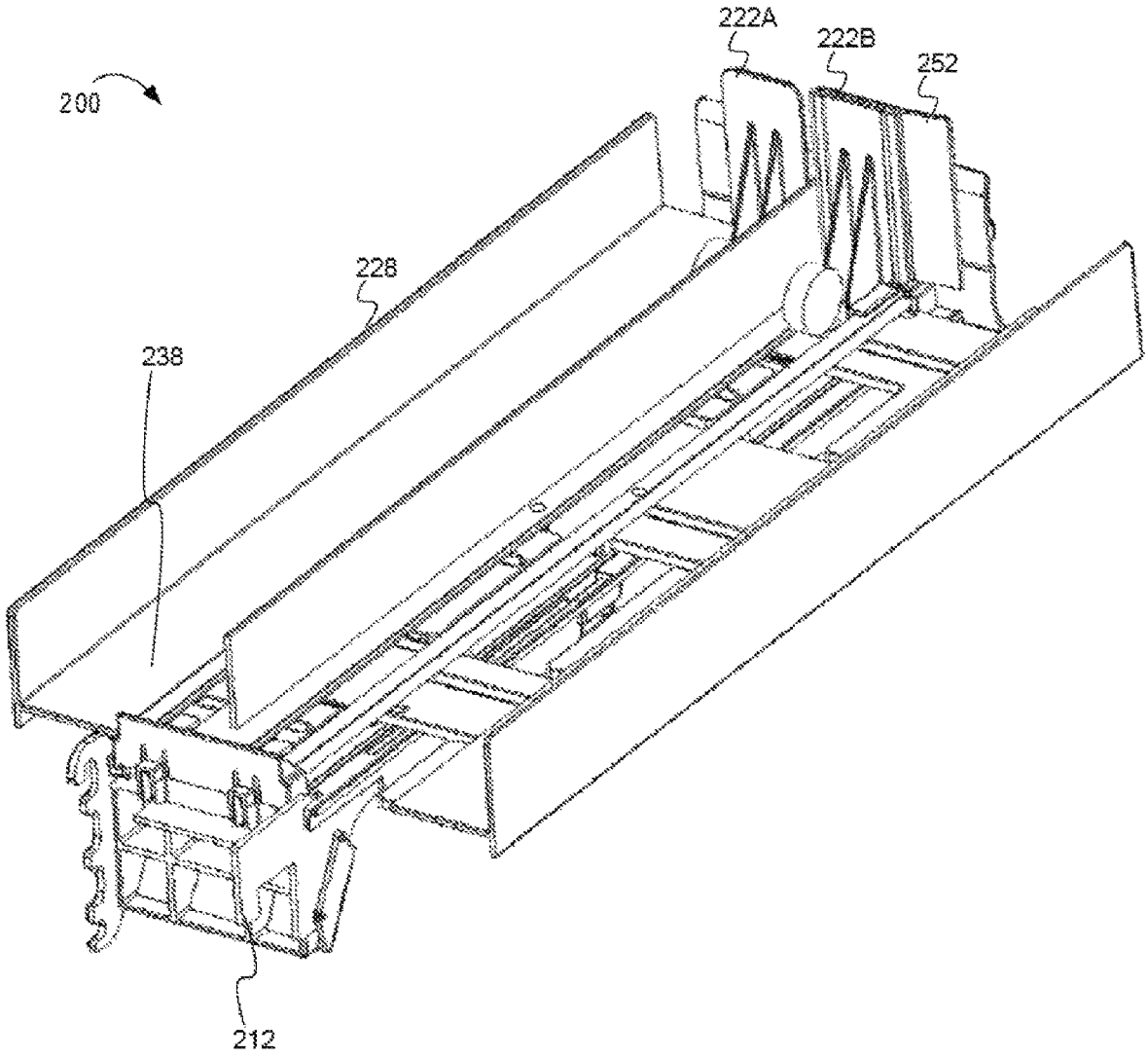
FIG. 2 is a perspective view of an alternate product display merchandiser in accordance with aspects of the invention taken from above the rear right corner of the merchandiser and illustrating the merchandiser with an alternate form of mounting bracket intended for use with bar mounted systems rather than grid systems, including alternate side members or wings for larger product and an exemplary pusher attachment accessory (note: while a bar mounting bracket and a grid mounting bracket are shown for comparison purposes, it should be understood that the merchandiser would be equipped with either two bar mounting brackets or two grid mounting brackets, rather than a combination of either).

While FIGS. 1A-1M depict a first embodiment of a product display merchandiser 100, FIG. 2 depicts a second embodiment of a product display merchandiser 200, according to some embodiments of the inventive subject matter. The product display merchandiser 200 includes sidewalls 228, pushers 222A and 222B, bracket engagement members 212, and a pusher attachment 252. The pusher attachment 252 attaches to the pusher 222B to expand the surface area of the pusher 222B. Additional types of pusher attachments exist. For example, pusher attachments can be designed for specific products, to minimize the surface area of the contact point with a product, to extend the depth of the pusher, etc. Additionally, FIG. 2 depicts a bracket engagement member 212 that is configured to engage a bar mounted system (not shown). Additionally, FIG. 2 depicts an embodiment of a product display merchandiser in which a horizontal portion of the sidewall 228 (i.e., the product support 238 portion of the sidewall) is roughly equal in area to a vertical portion of the sidewall 228.

Third Embodiment

Figure 3:
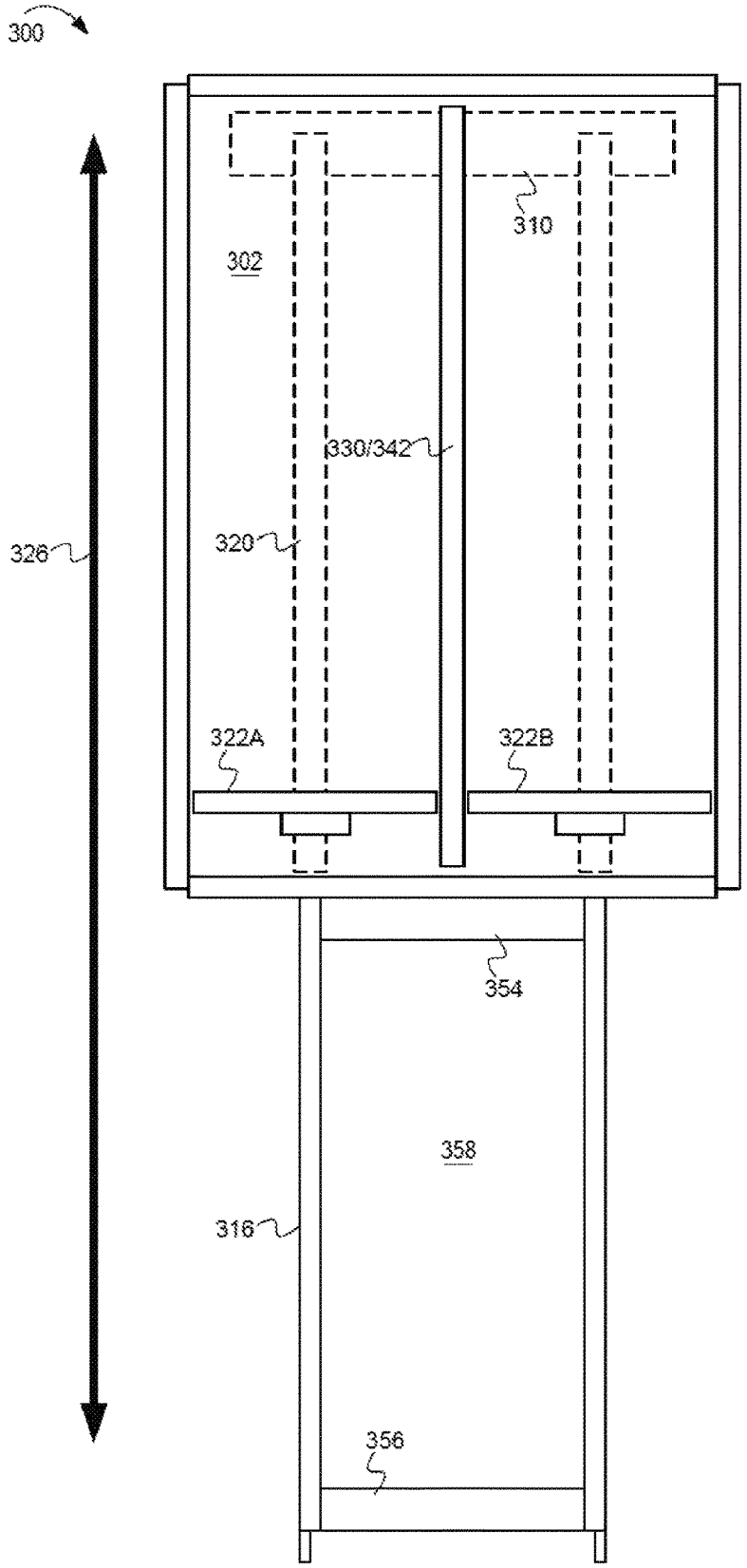
FIG. 3 is a top view of an alternate product display merchandiser in accordance with embodiments of the invention illustrating an optional front and/or rear stabilizer member connected to the mounting brackets for stabilizing same.

While FIG. 2 depicts a second embodiment of a product display merchandiser, FIG. 3 depicts a third embodiment of a product display merchandiser 300, according to some embodiments of the inventive subject matter. The product display merchandiser 300 includes a tray 302 that is slidable along arms 316. The tray 302 includes tracks 320 disposed on the bottom side of the tray 302. The arms 316 are seated in the tracks 320. The tray 302 moves in a direction as indicated by arrow 326 from an open position (shown) to a closed position (not shown). When in the open position, a void (or unobstructed opening) 358 is revealed (i.e., the product display merchandiser 300 has a baseless design). The void 358 is bounded on a left side and a right side by arms 316, on a front side by front stabilizer 354, and on a rear side by rear stabilizer 356. The tray also includes pushers 322A and 322B which are movable within in the tray 302 and a handle 310. In some embodiments, the handle 310 is operable to disengage engagement members so as to allow the tray 302 to be moved from the closed position to the open position. In one form, the tray 302 includes a divider 330/342. The divider 330/342 can be fixed to the tray 302 or removably attached to the tray 302.

Fourth Embodiment

Figure 4A:
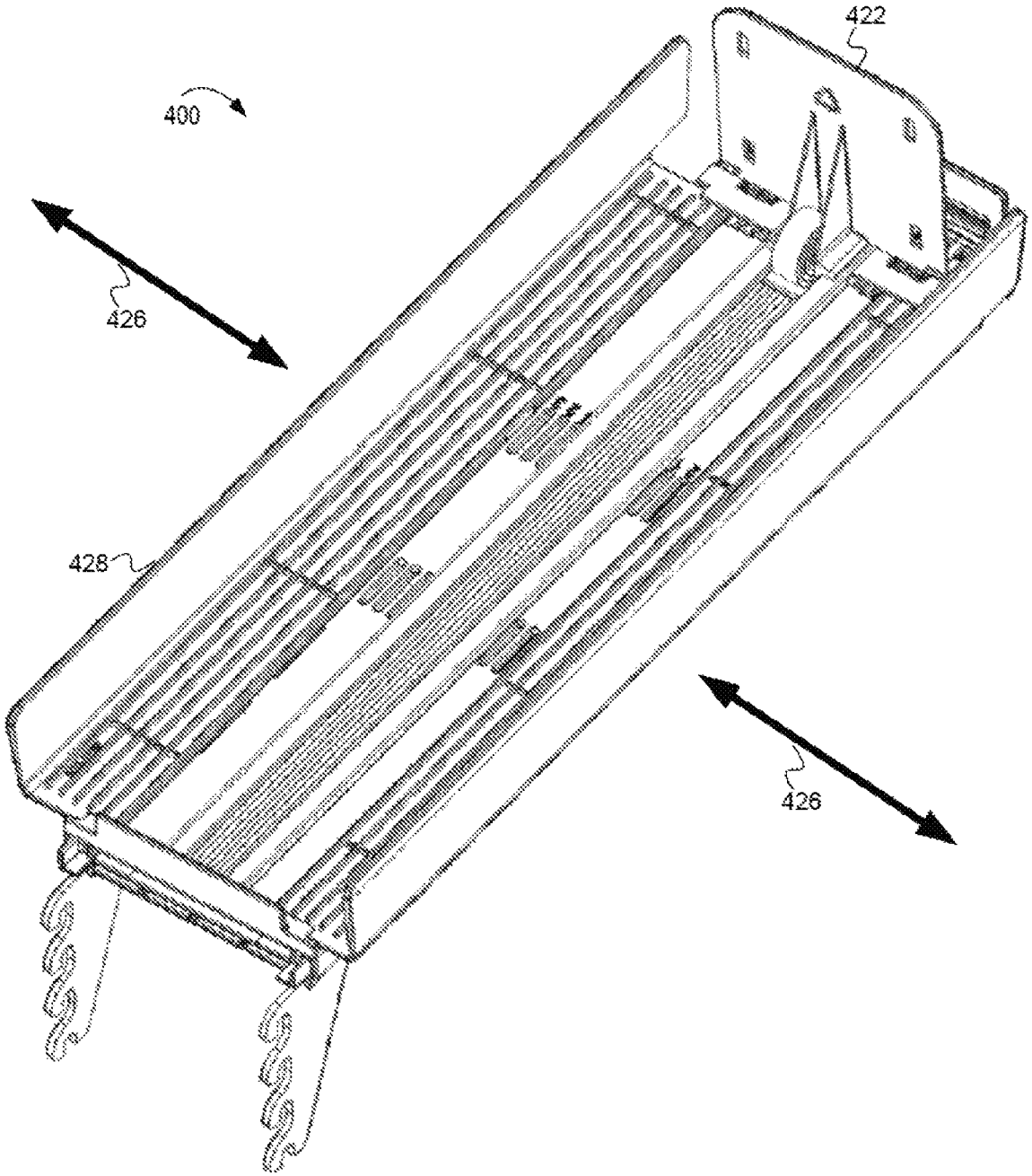
FIG. 4A is a perspective view of another product display merchandiser in accordance with embodiments of the invention taken from above and behind the merchandiser (or the right rear corner of the unit) and illustrating an alternate baseless tray or drawer type merchandiser design with an alternate manner for adjusting the side members or wings of the unit to adjust width of the merchandiser and an alternate means for securing the tray in the first, retracted position so as to avoid inadvertent movement of the merchandiser to the second, extended position (note: the left side member or wing is adjusted to a wider position than the right side member or wing simply to show that the merchandiser does not have to be setup symmetrically if desired).
Figure 4B:
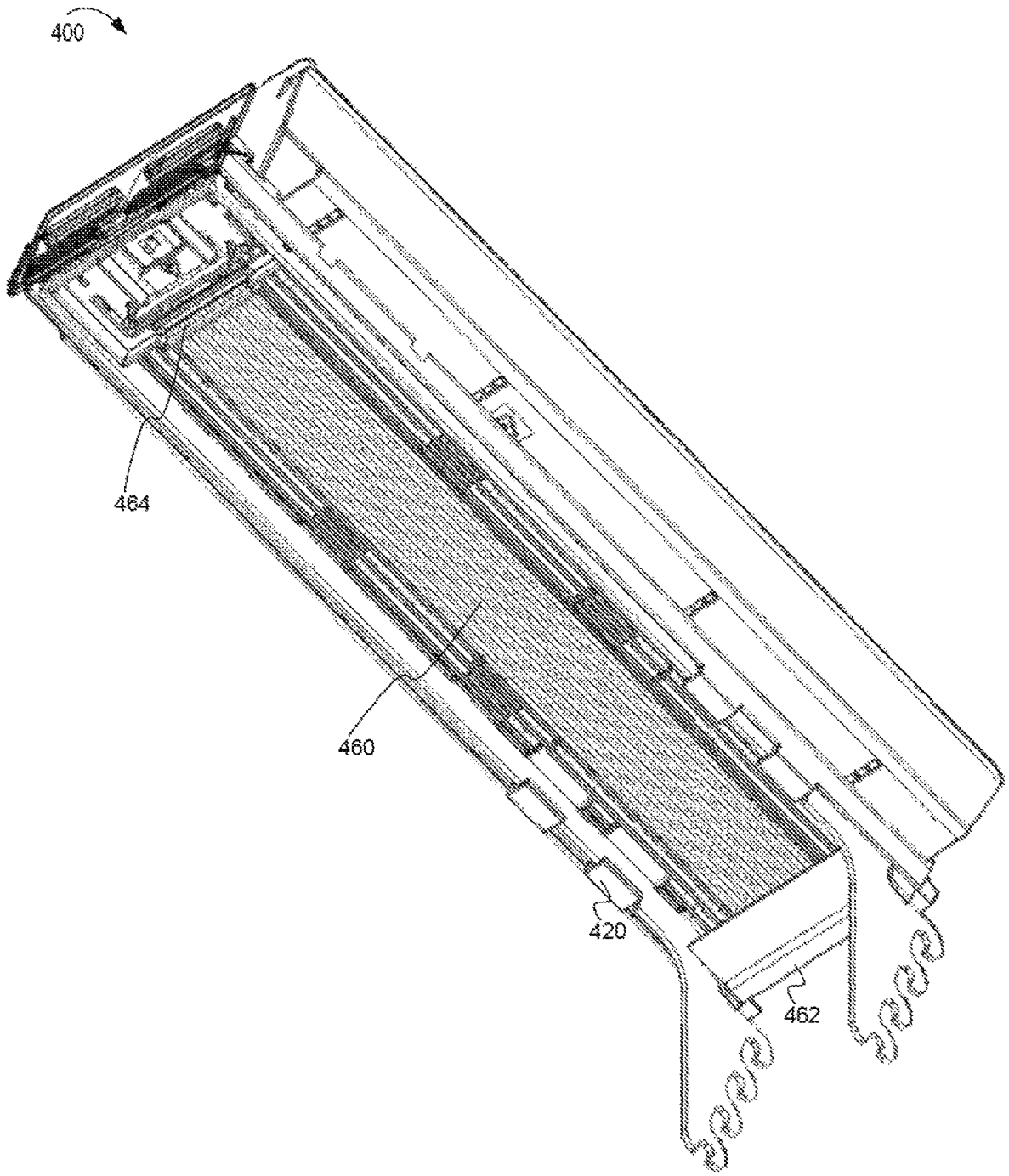
FIG. 4B is a perspective view of the merchandiser of FIG. 4A taken from below and in front of the merchandiser (or the lower left front corner of the unit) and illustrating the alternate rear stabilizer and adjustable width mechanism of the merchandiser.
Figure 4C:
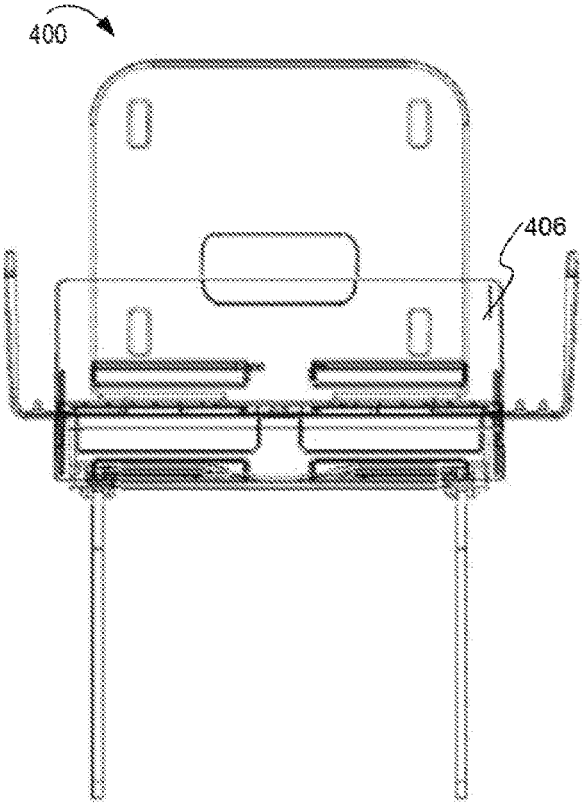
FIG. 4C-D are front elevation and rear elevation views of the product display merchandiser of FIGS. 4A-B again illustrating how the width of the left side member or wing has been adjusted more than the right (or the left side member has been displaced further from the center of the merchandiser or from a central axis running through the center of the merchandiser than the right side member is from the central axis).
Figure 4D:
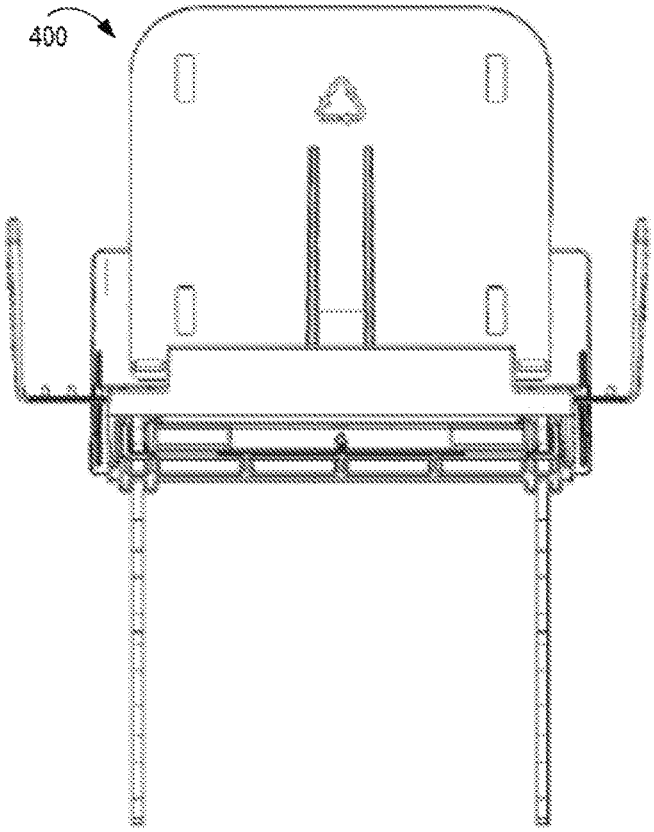
Figure 4E:
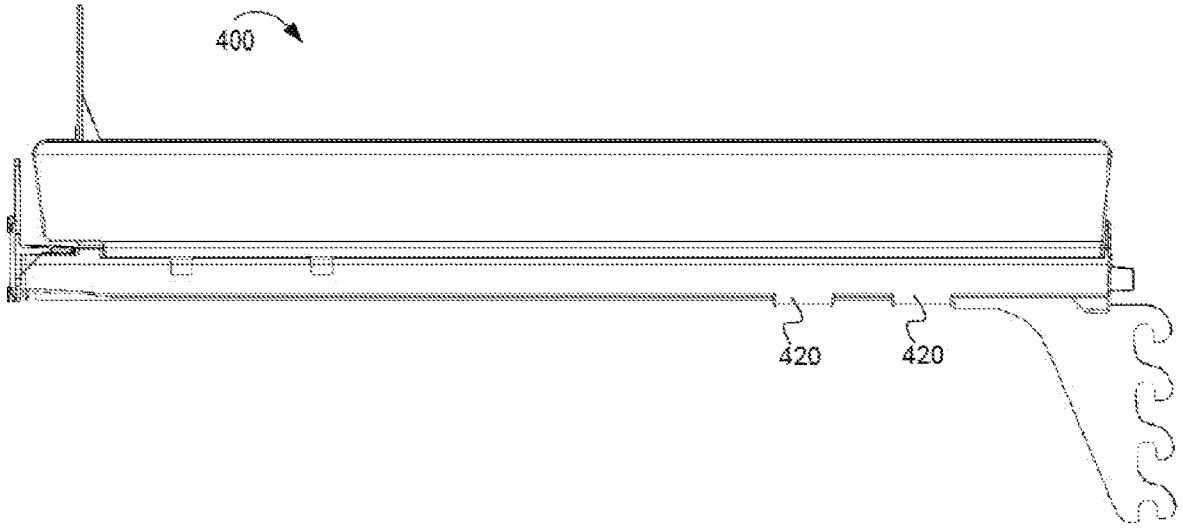
FIGS. 4E, 4F, and 4G are left side elevation, top, and bottom views, respectively of the product display merchandiser of FIGS. 4A-D illustrating the merchandiser in the same first, retracted or closed position the merchandiser is illustrated in for FIGS. 4A-D.
Figure 4F:
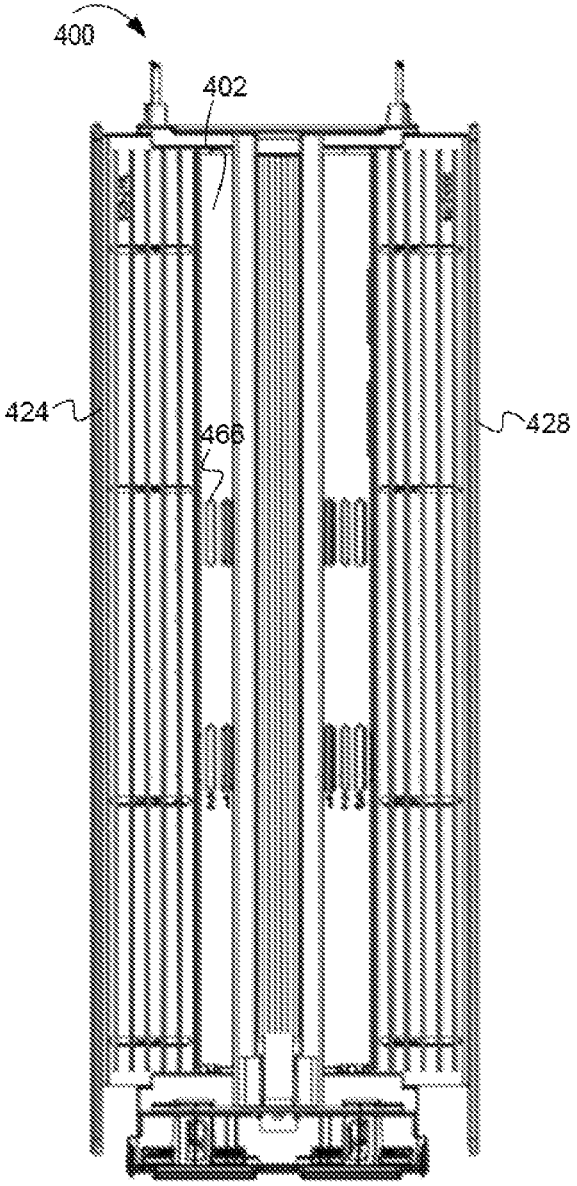
Figure 4G:
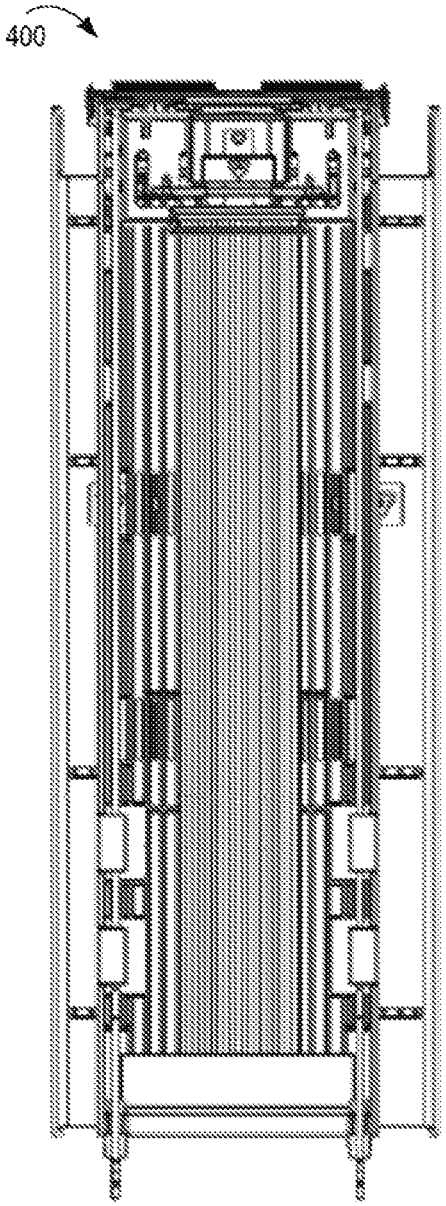
Figure 4H:
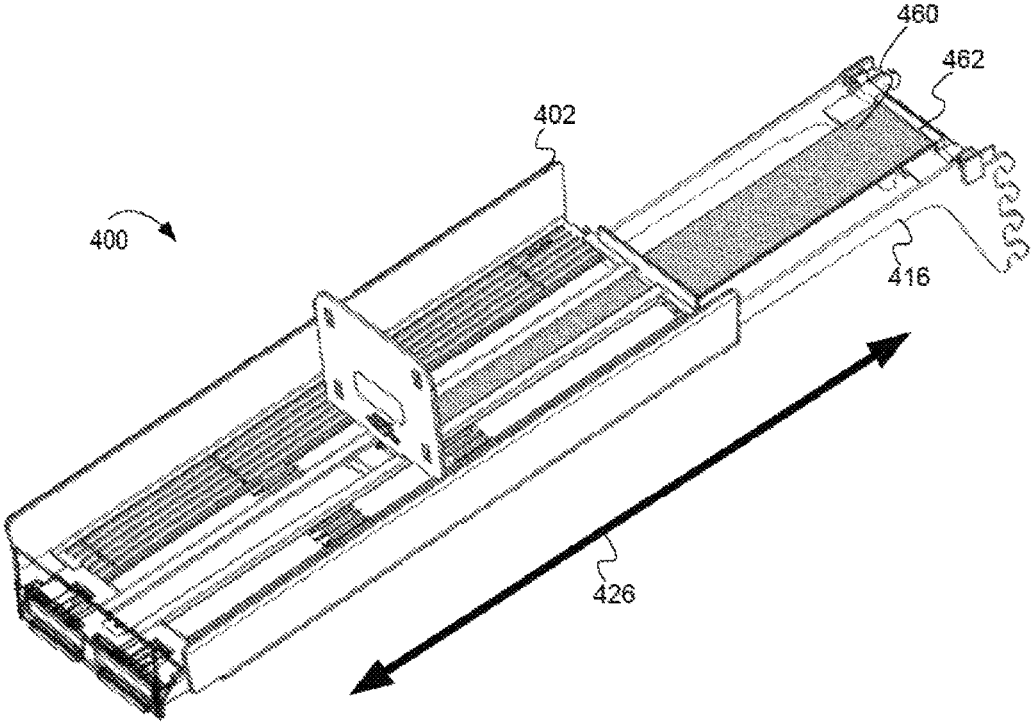
FIGS. 4H and 4I are alternate perspective and left side elevation views, respectively, of the merchandiser of FIGS. 4A-G illustrating the merchandiser in a second, extended or open position which a store associate may place the merchandiser in for stocking or restocking purposes.
Figure 4I:
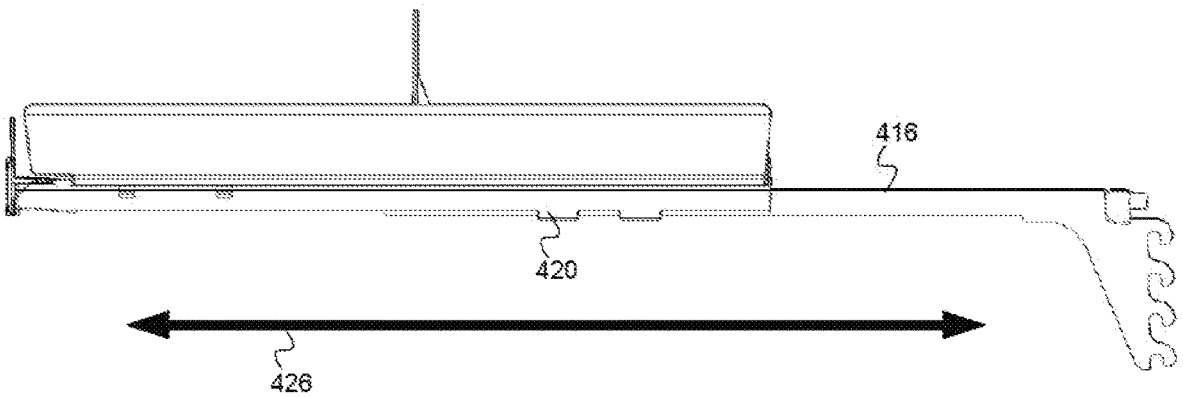
Figure 4J:
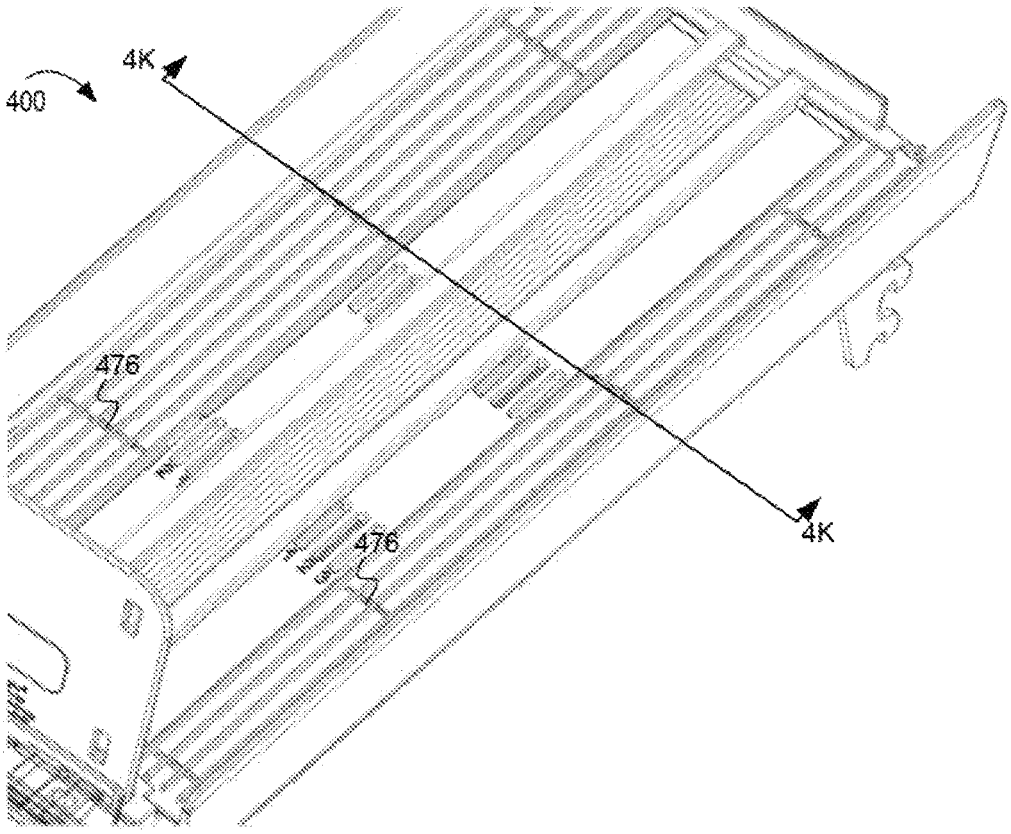
FIG. 4J is an enlarged, partial perspective view of the tray portion of the merchandiser of FIGS. 4A-4I illustrating how the width of the side members may be adjusted and how a user may keep track of same (again noting the left side member is illustrated as being adjusted to a wider position than the right side member).
Figure 4K:
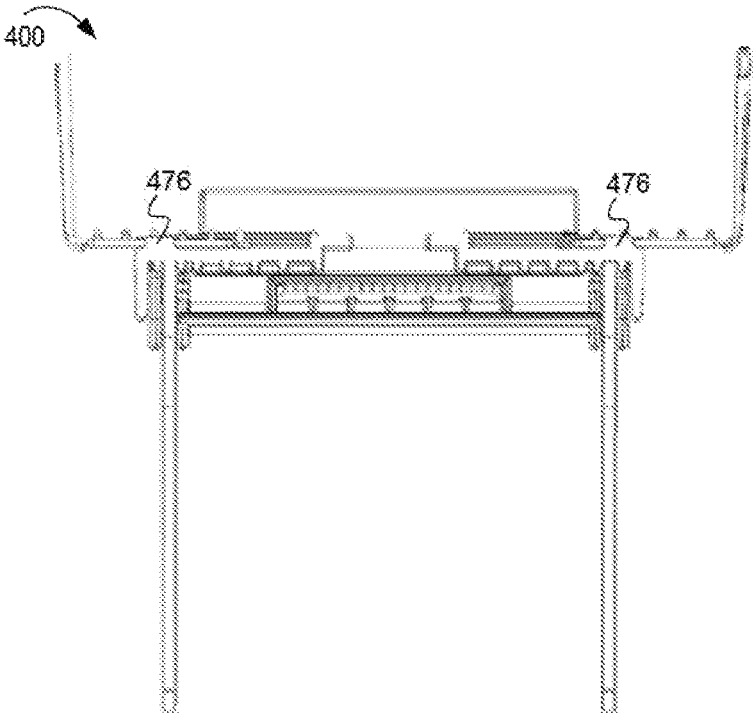
FIG. 4K is a cross-section of the merchandiser of FIG. 4J taken along line 4K-4K.
Figure 4L:
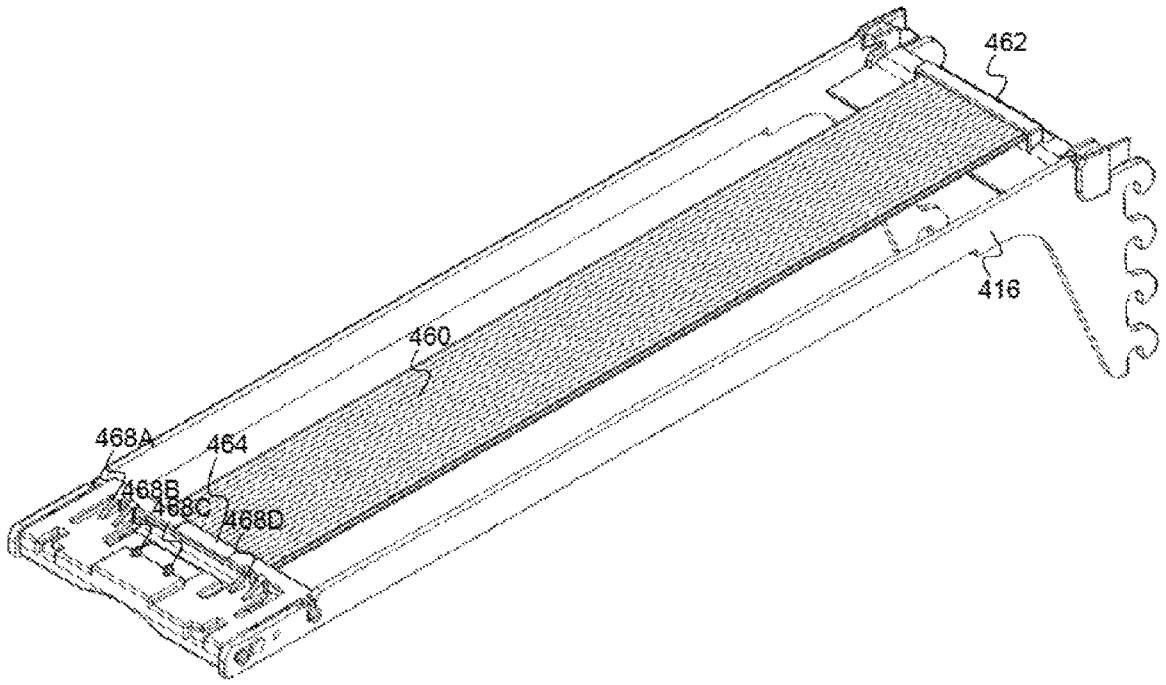
FIG. 4L is a partial perspective view of only a portion of the merchandiser of FIGS. 4A-4K illustrating the support brackets, first and second stabilizing members and a baffle structure for directing air from a rear of the merchandiser toward the front of the merchandiser and, thus, from the rear of any open-air refrigeration unit the merchandiser may be installed in toward the front of the open air refrigeration unit in order to assist in keeping product within the refrigeration unit at a generally uniform temperature. The front stabilizer also has a first mating structure for engaging a portion of the remainder of the merchandiser unit in order to retain the unit in the retracted position and/or prevent inadvertent movement of the merchandising unit to the second, extended position.
Figure 4M:
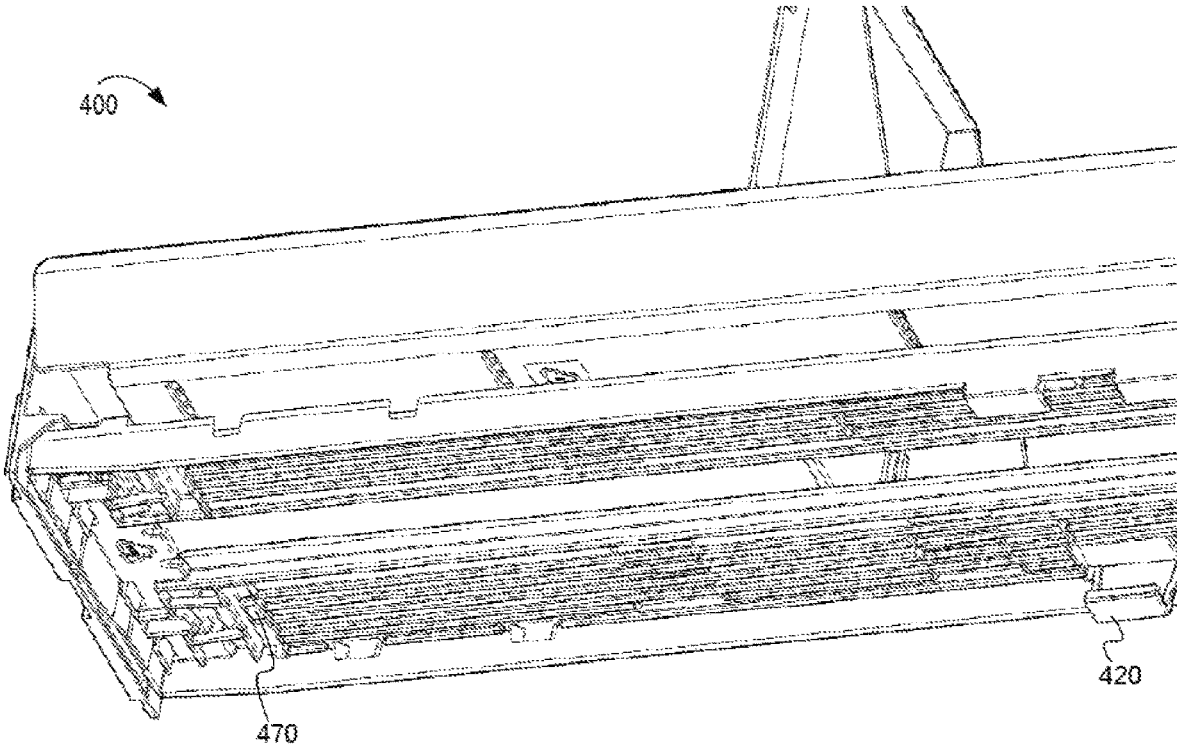
FIG. 4M is a partial perspective view of only a portion of the merchandiser of FIGS. 4A-4K illustrating second mating structures for engaging with the first mating structures of the merchandiser portions of FIG. 4L in order to retain the merchandising unit in the retracted position and/or to prevent inadvertent movement of the merchandising unit to the second, extended position.
Figure 4N:
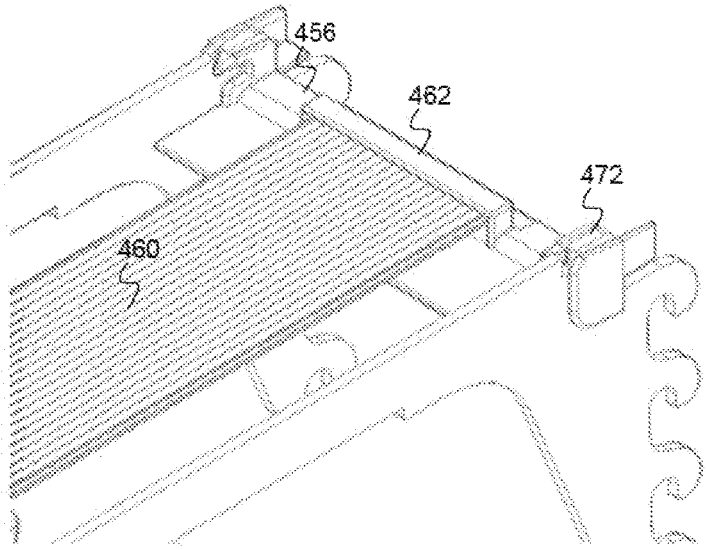
FIGS. 4N, 4O, and 4P are partial perspective views of the stabilizer located at the rear portion of the merchandiser of FIG. 4L illustrating from the front (FIG. 4N) and rear (FIG. 4O) how the baffle is inserted into or nested within the rear stabilizer and how the rear stabilizer is connected to the side members, and further illustrating in FIG. 4P what the rear stabilizer looks like when removed from the merchandiser.
Figure 4O:
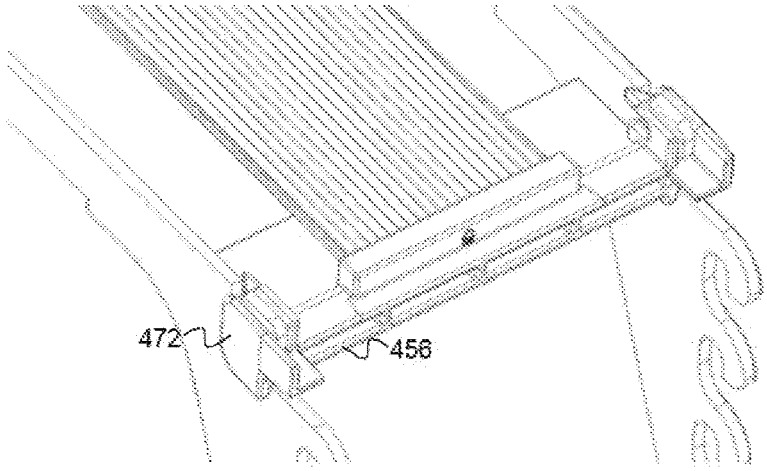
Figure 4P:
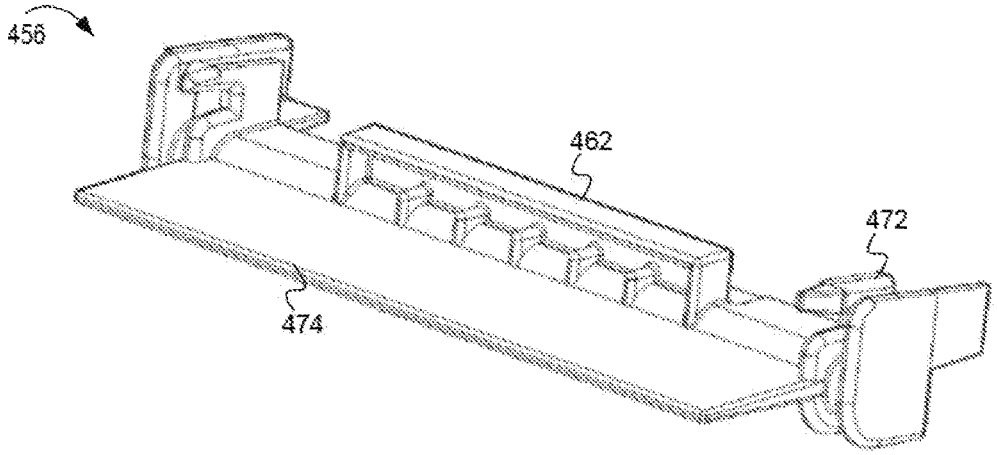
Figure 4Q:
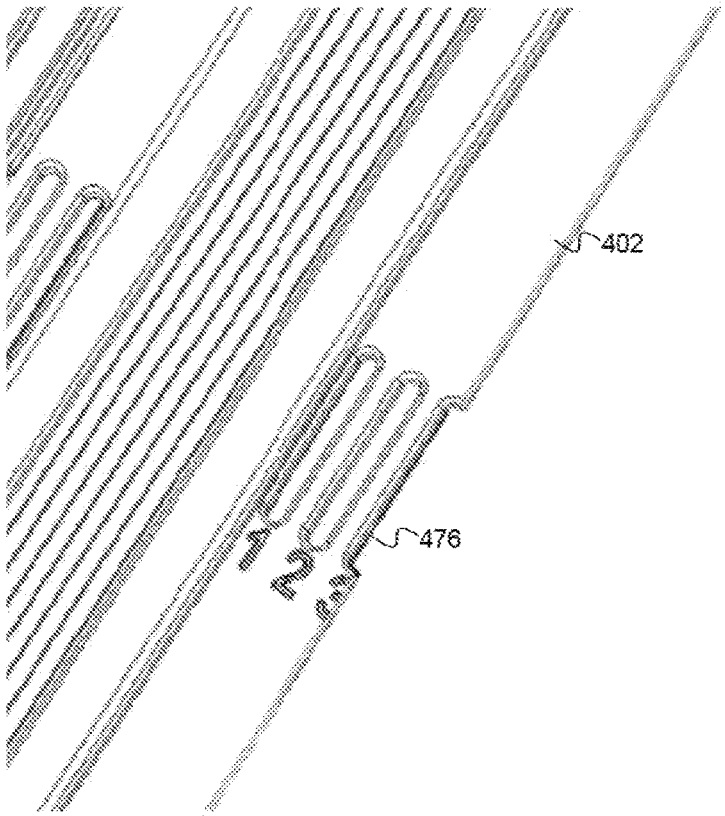
FIGS. 4Q and 4R are partial perspective views of the tray and a side member, respectively, depicted one exemplary mechanism for securing a side member to the tray.
Figure 4R:
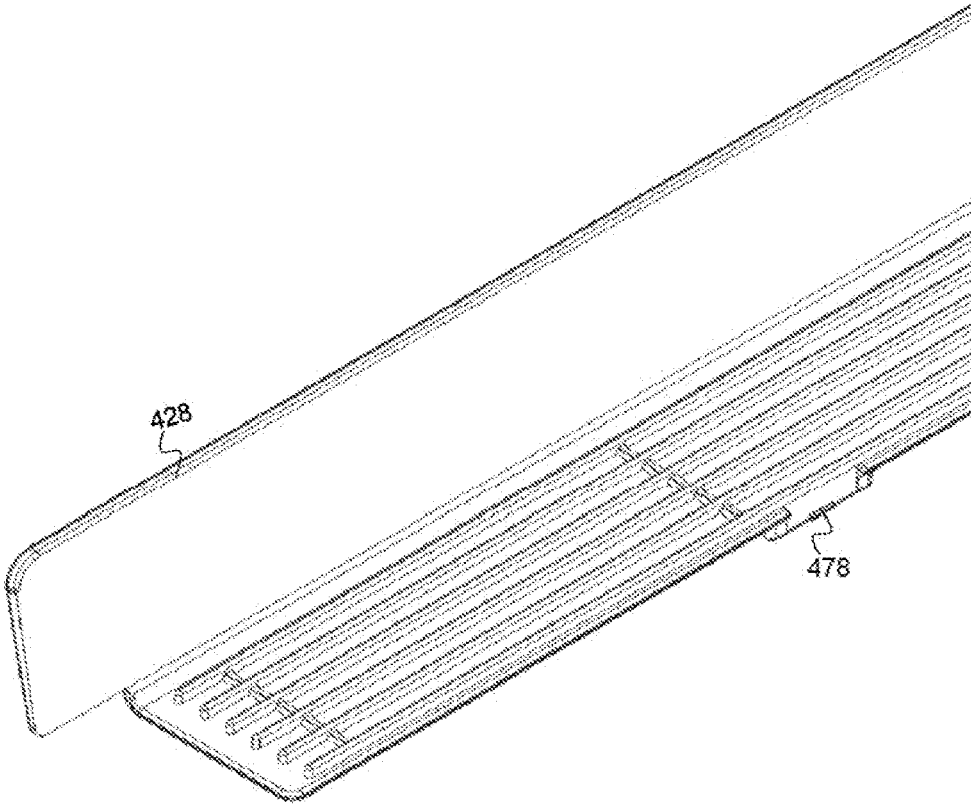

While FIG. 3 depicts a third embodiment of a product display merchandiser, FIGS. 4A-4R depict a fourth embodiment of a product display merchandiser 400 having an extendable tray width.

FIG. 4A is an upper perspective view of a fourth embodiment of the product display merchandiser 400 having adjustable side members 428, according to some embodiments of the inventive subject matter. The product display merchandiser 400 depicted in FIG. 4A has one pusher 422 and movable sidewalls 428. The sidewalls 428 are extendable from the tray in directions indicated by arrows 426. Extension of the sidewalls 428 allows for the tray width to be adjusted. The tray also includes first mating members 476 (best shown in FIG. 4Q) into which corresponding protrusions 478 (best shown in FIG. 4R) can seat to secure the sidewalls 428 in an extended position. In some embodiments, a horizontal portion of the sidewalls 428 includes second mating members (e.g., protrusions 478 extending from the horizontal portion of the sidewalls 428, as depicted in FIG. 4R) which fit into the first mating members 476. In some embodiments, the second mating members "snapfit" into the first mating members 476. For example, a person can lift an edge of one of the sidewalls 428 to disengage the second mating members from the first mating members 428. In one form, the sidewalls 428 are secured to the product display by one or more housing members or cords. Such housing members or cords can prevent the sidewalls 428 from becoming completely detached from the product display merchandiser 400 when disengaged. Once disengaged, the person can slide the sidewall 428 in and out until a desired spacing is achieved. Once the desired spacing is achieved, the person can push the sidewall back into place to reengage the second mating members with the first mating members 476 (i.e., snap the first mating members into the second mating members 476). In some embodiments, each of the sidewalls 428 are independently movable. For example, a first of the two sidewalls 428 can be moved, and then a second of the two sidewalls 428 can be moved independently of the first. In other embodiments, the sidewalls 428 can be coupled in such a manner that when one of the two sidewalls 428 is moved, the other of the two sidewalls 428 moves in a corresponding manner.

In some embodiments, the product display merchandiser 400 includes linear guides 476, depicted in FIGS. 4J and 4K. The linear guides 476 help ensure that the sidewalls 428 travel linearly with respect to the product display merchandiser 400 when moved between positions. In one form, the linear guides 476 are protrusions that are seated in recess disposed in a horizontal portion of the sidewalls 428.

Although FIG. 4Q depicts the first mating members 476 as incrementally spaced slots, any suitable mechanism for securing the sidewalls in an extended position may be employed. For example, one continuous aperture extending in a direction parallel to the direction in which the sidewalls 428 extend can be utilized. In such embodiments, any suitable fastener (e.g., a screw and nut combination) can be used to secure the sidewalls in an extended position. For example, a horizontal portion of the sidewalls can include a threaded shaft which protrudes through the continuous aperture. In such embodiments, the sidewall can be secured with a nut fastened to the threaded shaft. Alternatively, the horizontal portion of the sidewall can include an internally threaded aperture and the sidewall can be secured by inserting a screw through continuous aperture into the internally threaded aperture. Although multiple examples are given for the first mating members 476, numerous additionally possibilities exist and are considered within the scope of the teachings herein.

Additionally, although FIG. 4R depicts the second mating members 478 as protrusions and the first mating members as incrementally spaced slots, any suitable combination of second mating members 478 and first mating members 476 can be used. For example, the second mating members 478 can be shaped as pegs and the first mating members 476 can take the form of complementarily apertures in which the pegs can be seated.

FIG. 4B is a lower perspective view of the product display merchandiser 400 depicted in FIG. 4A. As seen in FIG. 4B, the product display merchandiser 400 includes tracks 420 (also well-depicted in FIG. 4M) through which arms 416 extend. The tray 402 is slidable along the arms in a direction as indicated by arrow 426 from a closed position (shown in FIG. 4E) to an open position (shown in FIG. 4I).

FIG. 4B also depicts a baffle 460 inserted on the underside of the product display merchandiser 400 and secured by a rear baffle mount 462 and a front baffle mount 464. The baffle 460 can server many different purposes, depending on a shape of the baffle 460, a material from which the baffle 460 is made, and a position of the baffle 460 within the product display merchandiser 400. For example, the baffle 460 can server to direct airflow through or around the product display merchandiser 400. Additionally, in some forms, the baffle 460 can be removably attached to the product display merchandiser 400 by insertion and removal from the rear baffle mount 462 and the front baffle mount 464.

The arms 416, baffle 460, rear baffle mount 462, front baffle mount 464 are well-depicted in FIG. 4L. FIG. 4L also depicts a first tray engagement mechanism 468A-468D which acts to maintain the tray 402 in the closed position. A second tray engagement mechanism 470 (best shown in FIG. 4M) mates with the first tray engagement mechanism 468A-468D when the tray is in the closed position. In some embodiments, such as those depicted in FIG. 4P, the rear baffle munt 462 and insert support surface 414 are integral to the rear stabilizer 456. Additionally, the rear stabilizer 456 can attach to the arms 416 via stabilizer engagement members 472.

Fifth Embodiment

While FIGS. 4A-4R depict a fourth embodiment of a product display merchandiser 400 having an extendable tray width or adjustable width feature, FIGS. 5A-5E depict a fifth embodiment of a product display merchandiser 500 having an alternate manner for adjusting the width of the side members 528, 524 and securing them in position so that they cannot be moved once the merchandiser is stocked with product and installed on a shelf, grid or bar.

The product display merchandiser 500 of FIG. 5 includes a left sidewall 528, a right sidewall 524, a tray 502, arms 516, a removable divider 530, a lens 506, and rear stabilizer 556. The left sidewall 528 and right sidewall 524 are securable to the tray 502. The tray 502 mounts to, and is supported, by the arms 516. In a preferred form, the tray 502 is slidable along the arms 516 to an open or extended position making loading product onto the product display merchandiser 500 easier and in a manner that does not require a separate base structure that the tray slides upon.

The positions of the left sidewall 528 and the right sidewall 524 are adjustable or moveable with respect to the tray 502. Such adjustability or movability allows the distance between the left sidewall 528 and the right sidewall 524 to be adjusted to accommodate products of varying size and dimension.

Figure 5A:
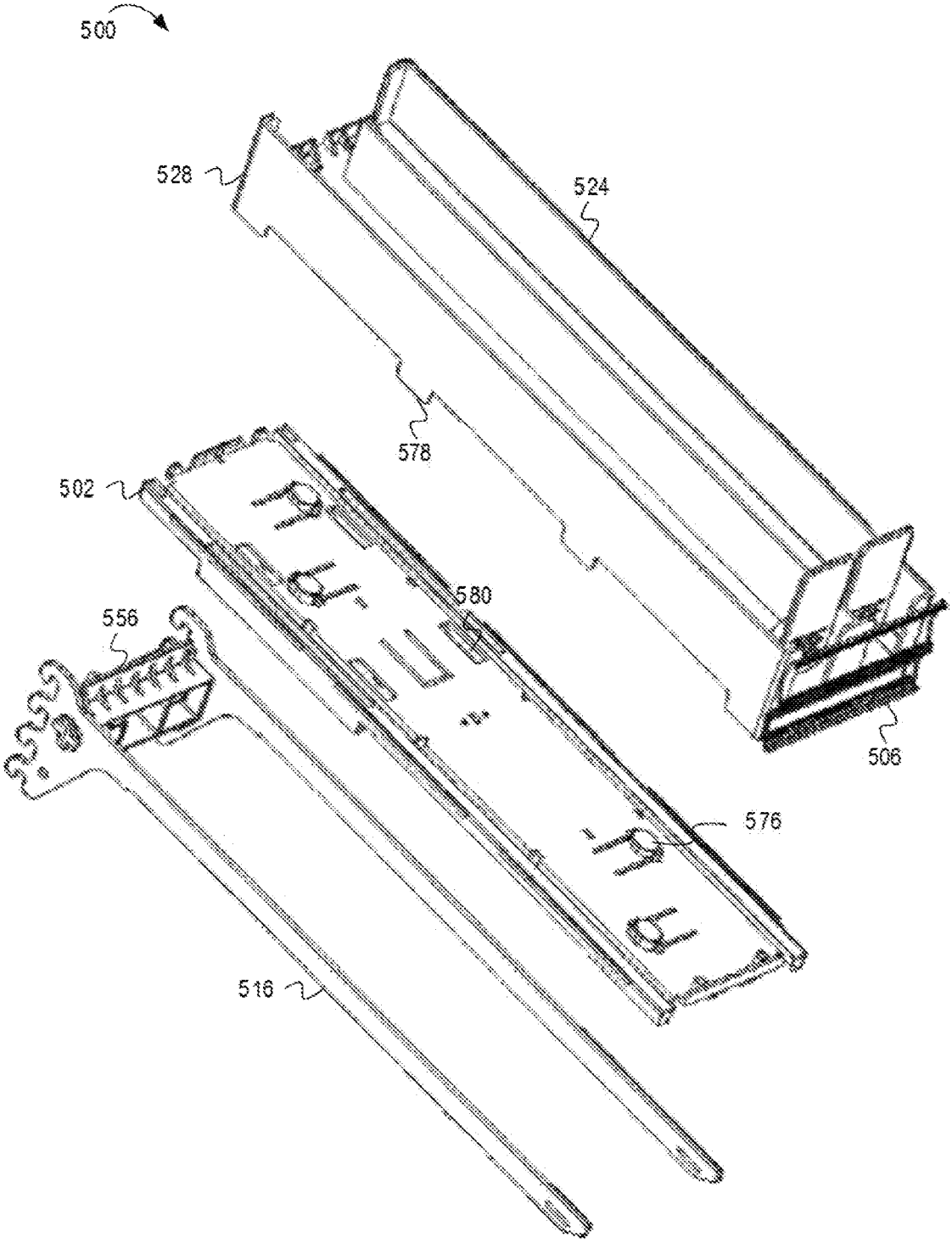
FIG. 5A is an exploded view of another product display merchandiser in accordance with embodiments of the inventive subject matter having an alternate manner for adjusting the side member or wings of the unit to adjust width of the merchandiser.
Figure 5B:
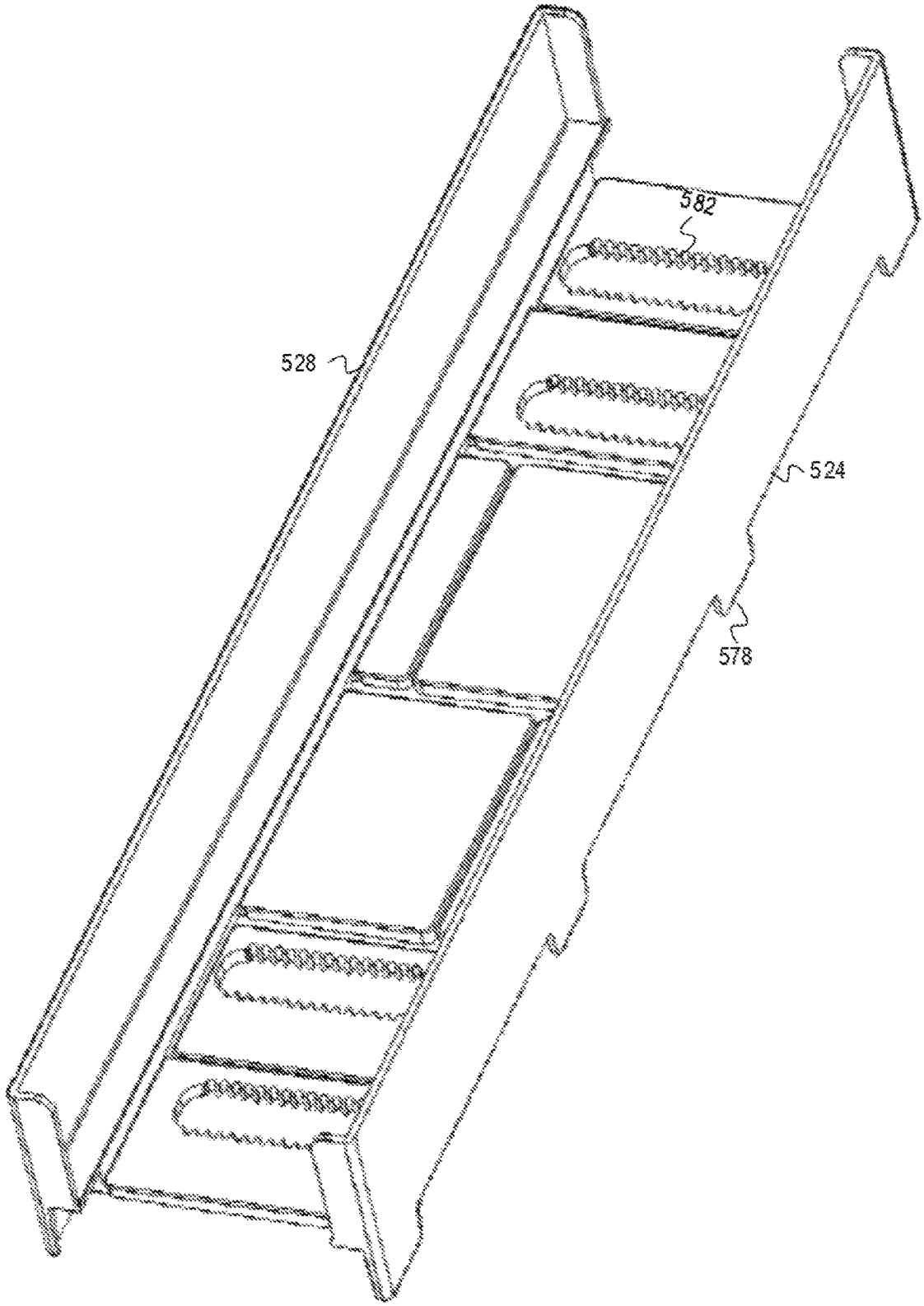
FIGS. 5B and 5C are perspective views of the side members or wings of the product display merchandiser depicted in FIG. 5A.
Figure 5C:
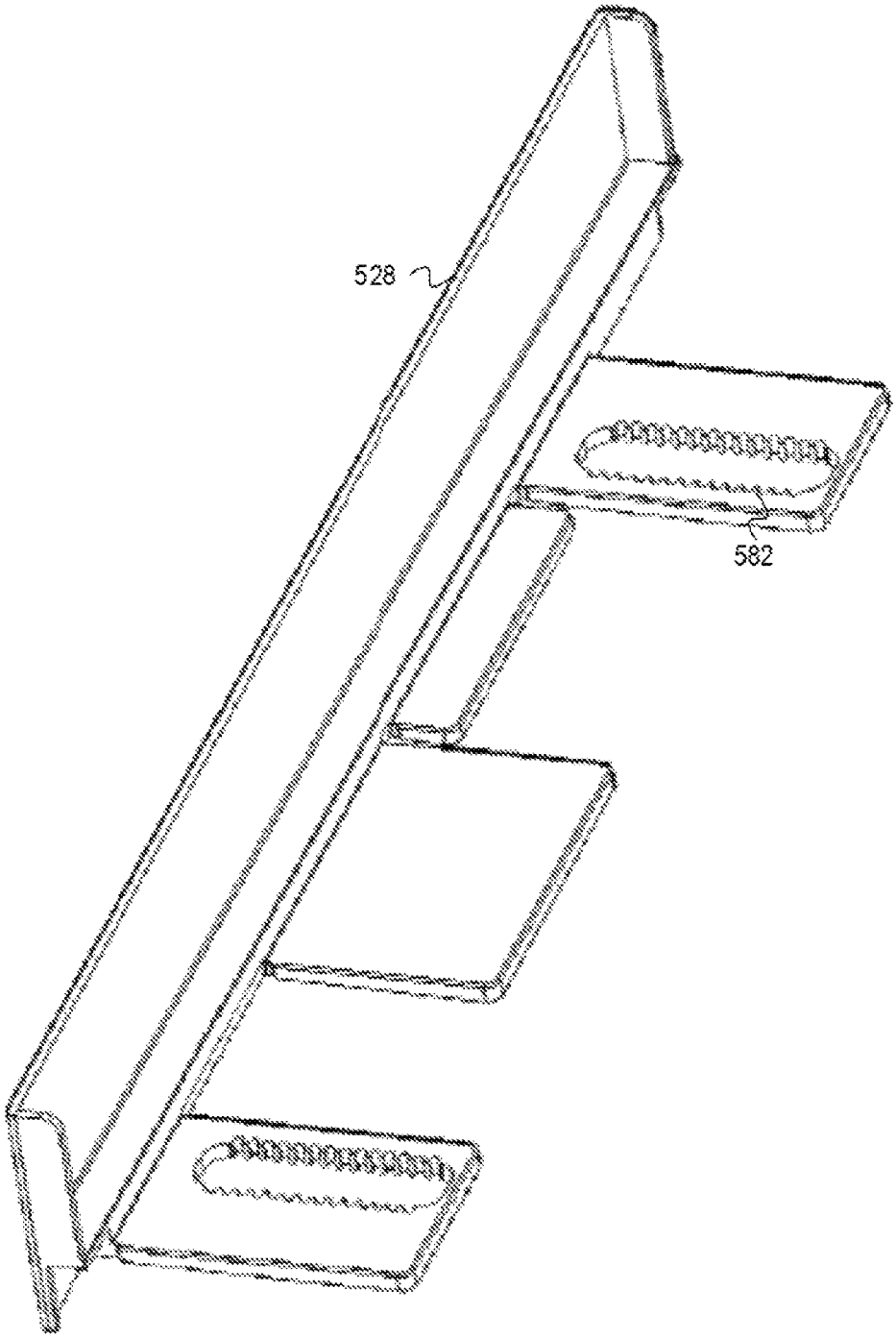
Figure 5D:
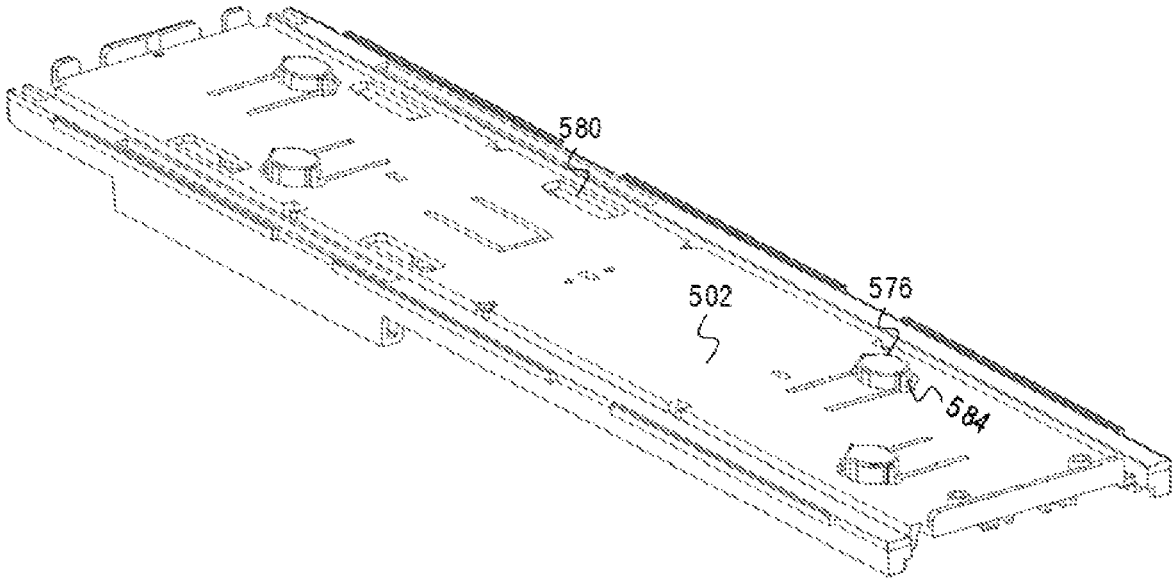
FIG. 5D is a perspective view of a tray of the product display merchandiser depicted in FIG. 5A.

In one form, the left sidewall 528 and right sidewall 524 include tongue engagement portions 582, e.g., grooves, (as shown in FIGS. 5B-5C) that mate with the tongues 576 on the tray 572. Although FIGS. 5A-5E depict the left sidewall 528 and right sidewall 524 as including tongue engagement portions 582, in some embodiments, the tray 502 can include tongue engagement portions or grooves 582 and the left sidewall 528 and the right sidewall 524 can include the tongues 576. In yet other embodiments, the tray 502 may have tongue and tongue engagement portions and the sidewalls 524, 528 may have tongue engagement portions and tongues that correspond with and/or mate with those on the tray 502. In any of these embodiments, the tongues 576 mate with the tongue engagement portions or grooves 582 to secure the left sidewall 528 and the right sidewall 524 in a desired position on tray 502. In the embodiment shown in FIG. 5E, the tongues 576 are formed into the tray 502 and include a raised portion that engages the tongue engagement portions of the left sidewall 528 and the right sidewall 524. The tongues 576 are deformable (e.g., can be pushed from a first, resting position to a second, deformed position) to disengage from the tongue engagement portions 582 and allow the position of one or more of the left sidewall 528 and the right sidewall 524 to be adjusted.

In one form, the tongues 576 and/or tongue engagement portions 582 can include a mechanism (e.g., an indexing mechanism) that allows movement of the left sidewall 528 and the right sidewall 524 between predefined or predetermined positions. For example, as depicted in FIGS. 5A-5E, the tongues 584 include protrusions 584 (e.g., finger members) that seat within the serrated boundaries of the tongue engagement portions 582. Such embodiments allow for very fine adjustments of the left sidewall 528 and right sidewall 524. Further, if it is desired to set the width of the sidewalls of numerous merchandisers to the same width setting, this can be done by counting which groove or serration the tongue should be set to and simply setting the protrusion to that serration for each sidewall. To assist in this effort, indicia may be added to one or more serrations or grooves in order to make quick adjustments to that setting on one or many merchandisers.

Although FIGS. 5A-5E depict tongues 576 as having protrusions 584 and left sidewall 528 and right sidewall 524 as having tongue engagement portions 582 with serrated boundaries, other mechanisms exist for allowing movement of the left sidewall 538 and the right sidewall 524 between predefined positions, such as those depicted and described in FIG. 4 and the associated text, or any other suitable mechanism. Additionally, in some forms, the left sidewall 528 and right sidewall 524 include sidewall tabs 578 that mate with sidewall tab recesses 580 located on the tray 502 to aid in securing the sidewalls to the tray 502 and ensuring a desired position of the sidewalls is retained. Further, as mentioned above, while various tongue and groove type mating structures may be used to mate the sidewalls to the tray, other types of mating engagements may be used and, of these, they may be alternated so that some appear on both the tray and sidewalls. For example, in some forms, dovetail mating configurations or mortise and tenon mating configurations may be used. In still other forms, other protrusion and mating recess type configurations may be used.

In addition to simply providing adjustability, the mechanism described above also helps to ensure that the left sidewall 528 and right sidewall 524 will remain in desired positions after the width of the product display merchandiser 500 has been set. For example, to adjust the position of the left sidewall 528 and the right sidewall 524 the tongues 576 must be manipulated so that they no longer engage the tongue engagement portions 582. Because the tongues 576 are positioned on the tray 502, the tongues are not easily accessible when the product display merchandiser 500 contains product. Because the tongues 576 are not easily accessible, it is unlikely that they will be manipulated unintentionally (e.g., by an employee, heavy product, a customer, etc.). Consequently, the left sidewall 528 and right sidewall 524 remain in a relatively fixed position until such position is intentionally altered. Additionally, because the position of the left sidewall 528 and the right sidewall 524 is relatively fixed, some embodiments of the inventive subject matter are able to hold and display heavier products, as it is less likely that such products will cause the left sidewall 528 and the right sidewall 524 to move out of position. This is helpful in avoiding the merchandiser from inadvertently being changed by retailer stocking associates or the like after it has been set or configured in the desired manner to display specific products.

Figure 5E:
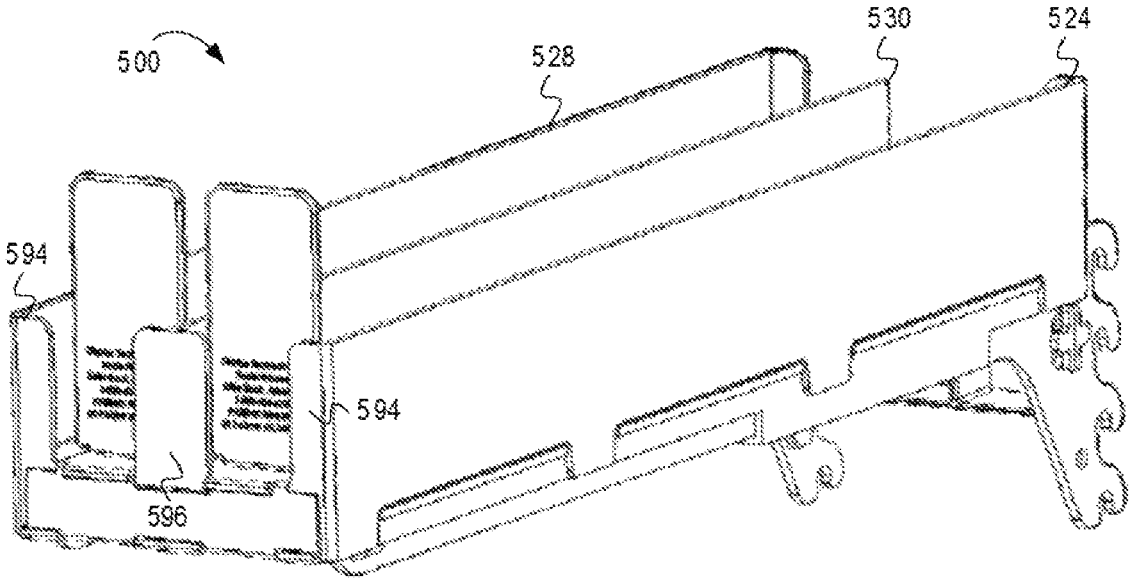
FIG. 5E is a perspective view of a product display merchandiser with a lens removed.

In one form, as depicted in FIG. 5E, the lens 506 of the product display merchandiser 500 may be removable. In such embodiments, the product display merchandiser can include stops, or protrusions, 594, 596. Such stops 594, 596 can prevent product from falling out of the product display merchandiser 500 when the lens 506 is removed. The stops 594 can be integral to the tray 502 or left sidewall 528 and right sidewall 524. The stop 596 can be integral to the tray 502 or the center divider 530 (whether or not the center divider is removable). This allows product in certain situations to be advantageously displayed without a lens so that an unobstructed view of the displayed product may be seen by potential consumers.

In the form illustrated in FIGS. 5A-E the wings or side members 528, 524 preferably will define product support surfaces extending inward toward the opposing side member 528, 524 for supporting at least a portion of the displayed product. An example of this product support surface is illustrated in FIG. 5B for the left side member 528. This product support surface runs from the rear of the merchandiser toward the front of the merchandiser and terminates in the protrusions or stops 594, 596. In some forms, the side members 528, 524 preferably form stops or abutting surfaces that limit how close the side members 528, 524 can be moved toward one another. More particularly, the portions of each side member that define the tongue engagement openings or grooves 582 that protrusions or tongue members 584 engage form distal ends that abut the opposing side member 528, 524 to limit the travel of the side members 528, 524 toward one another. In the form illustrated, the side members 528, 524 contain additional protruding members coplanar with the portions that define the tongue engagement openings 582 that further serve as abutment surfaces that limit travel of the side members 528, 524 toward one another. These additional protrusions or protruding members are illustrated for the left side member 528 best in FIG. 5C and are positioned between the portions that define the tongue engagement openings 582.

Sixth Embodiment

While FIGS. 5A-5E depict a fifth embodiment of a product display merchandiser having an alternate manner for adjusting the side members, FIGS. 6A-6D depict a sixth embodiment of a product display merchandiser 600 having a mechanism to securely attach a bracket engagement member 612 to a rear stabilizer 656. The product display merchandiser 600 includes a left sidewall 628, a right sidewall 624, arms 616, a rear stabilizer 656, a tray, and bracket engagement members 612. The arms 616 support the tray and are connected to the rear stabilizer 656 via the bracket engagement members 612. The arms 616 and rear stabilizer 656 connect to the bracket engagement members 612. For example, in one form, the bracket engagement members 612 can be fastened to the rear stabilizer 656. The bracket engagement members 612 engage a vertical support (not shown) such as a bar mounted system or a grid mount system from which the product display merchandiser 600 can hang. In the form illustrated, the bracket engagement members 612 and one arm 616 are formed integral to one another as a metal support arm.

The bracket engagement members 612 include a locking receiver 686 that mates with a locking protrusion 688 located on the rear stabilizer 656. The locking receiver 686 and the locking protrusion 688 mate in such a way as to securely affix the bracket engagement member 612 to the rear stabilizer 656. The locking receiver 686 and the locking protrusion 688 can take any suitable form. For example, the locking receiver 686 can be an aperture through which the locking protrusion 688 extends, a cavity that receives the locking protrusion 688, a clip to which the locking protrusion 688 attaches, etc.

In the example depicted in FIGS. 6A-6D, the locking protrusion 688 is a piece of material that extends from the rear stabilizer 656. The locking protrusion 688 can be integral to the rear stabilizer 656 or a separate piece that is attached to the rear stabilizer 656. The locking receiver 686 can take the form of an aperture located in the bracket engagement member 612. As depicted in the FIGS. 6A-6D, the locking protrusion 688 and the locking receiver 686 are similarly shaped (or correspond in shape) and have a slightly different orientation (e.g., approximately 45° out of alignment). The locking protrusion 688 and the locking receiver 686 can take any suitable shape. In the example depicted in FIGS. 6A-6D, the locking protrusion 688 and the locking receiver 686 are cross-shaped. In such embodiments, the bracket engagement member 612 is placed onto the rear stabilizer 656 in a first position such that the locking receiver 686 and the locking protrusion 688 are oriented in a similar direction. Once the engagement bracket 612 has passed the locking protrusion 688, the bracket engagement member 612 can be rotated to a second position, the second position being a display position for the product display merchandiser 600. Once in the second position, the locking protrusion 688 acts on the bracket engagement member 612 to securely hold the bracket engagement member 612 and the rear stabilizer 656 together. For example the locking receiver 686 may fit behind a larger portion of the locking protrusion 688 in such a manner as to experience a clamping force or camming force between an inner surface of the locking protrusion 688 and the rear stabilizer 656.

In the form illustrated, the protrusions 688 correspond in shape with the locking receiver opening 686 so that the protrusion may be orientated into a position to be inserted into the opening 686. The protrusion 688 further defines a cutout, channel or groove that the locking receiver may be aligned with and then one or both the rear stabilizer 656 and integrated arm 616 and engagement member 612 are moved with respect to each other to securely clamp or fasten the integrated arm 616 and engagement member 612 to one end of the stabilizer 656. The same process is then repeated with the protrusion located on the opposite end of the stabilizer 656. In a preferred form, the cutout, channel or groove, is configured to either cam against the engagement member 612 or form a friction fit with the engagement member 612. Thus, once fully assembled, the three pieces (i.e., rear stabilizer and support arms/engagement members 612 are securely connected to one another to minimize play between each item.

Additionally, in some embodiments, the rear stabilizer 656 can include an alignment protrusion 692 and the bracket engagement member 612 can include a mating alignment recess 690. The alignment protrusion 692 and the alignment recess 690 can be positioned in such a manner as to engage when the bracket engagement member 612 is in the second position. The alignment protrusion 692 and alignment recess 690 can aid in assembly of the product display merchandiser 600 and provide greater stability to the product display merchandiser 600. In a preferred form, the mating alignment recess 690 and protrusion 692 correspond in shape (e.g., both are circular or other curved structures, rectangular or triangular or other polygonal structures, etc.). In addition, while the illustrated rear stabilizer 656 having protrusions 692 on opposing sides of the stabilizer and, thus, the respective engagement members 612 each have a mating recess 690, it should be understood that in alternate forms, only one side of the stabilizer 656 may include a protrusion and only one bracket engagement member 612 will include a mating alignment recess.

Similarly, although FIGS. 6A-6D depict the rear stabilizer 656 as having the locking protrusions 688 and the bracket engagement member as having the locking receiver 686, embodiments are not so limited. For example, in one form, the rear stabilizer 656 can include the locking receiver 686 and the bracket engagement member 612 can include the locking protrusion 688. Similarly, in some embodiments, the bracket engagement member 612 can include the alignment protrusion 692 and the rear stabilizer 656 can include the alignment recess 690. Additionally, although many of the figures (including FIGS. 6A-6D) depict the arm 616 and the bracket engagement member 612 as a single piece, in some embodiments, the arm 616 is separate from, and attachable to, the bracket engagement member 612.

Similarly, while this engagement has been described as requiring the engagement bracket 612 to be moved or rotated, it should be understood that in the illustrated embodiment, the engagement bracket 612 does not have to move, but rather the rear stabilizer 656 could alternatively be moved or, in yet other forms, both could be moved with respect to each other. The point being that via some movement of either the engagement bracket 612 and/or the stabilizer 656, the two items are moved from a first position wherein the two items can be removed from one another or connected to one another, and then be moved to or toward a second position wherein the two items are secured to one another via a clamping or camming force or other fastening engagement. This same procedure can be done for the protrusion 688 extending from the opposite side of the stabilizer and the other integrated engagement bracket and support arm illustrated on the opposite side of the stabilizer 656.

Seventh Embodiment

While FIGS. 6A-6D depict a sixth embodiment of a product display merchandiser having a mechanism to securely attach a bracket engagement member to a rear stabilizer, FIGS. 7A-7B depict a product display merchandiser 700 in which one or more of the product display merchandiser's 700 sidewalls is removable. The product display merchandiser 700 includes a tray 702, a left sidewall 728 attached to the tray 702, an arms 716. The tray 702 is slidable along the arms 716 from a first retracted or closed position (depicted in FIG. 7A) to an open, or extended positon (depicted in FIG. 7B). The product display merchandiser 700 can also include a right sidewall (not shown). In the embodiment depicted in FIGS. 7A-7B, the right sidewall has been removed from the product display merchandiser 700. In such a configuration, two or more product display merchandiser 700 can be mounted adjacent to one another on a bar or grid system by way of bracket engagement members 712 so as to utilize one or more sidewalls of an adjacent product display merchandiser(s). For example, all product display merchandisers 700 in an arrangement of product display merchandisers 700 may have their right sidewalls removed (except for the rightmost product display merchandiser). In such a configuration, product presented in a product display merchandiser 700 will be supported on the left by the left sidewall 728 of the product display merchandiser 700 and on the right by the left sidewall of the right-adjacent product display merchandiser. In such embodiments, the tray 702 and one or more of the left sidewall 728 and the right sidewall can be designed in a complimentary manner such that the tray 702 and the left sidewall 728 and/or right sidewall create a continuous or nearly continuous surface.

Not only does such a configuration allow product display merchandisers 700 to be placed in closer proximity to one another, but also decreases difficulty in loading the product display merchandisers 700. For example, most product display merchandisers have two sidewalls and a base, allowing product stocking to be performed only from above the product display merchandiser (e.g., top loading of the merchandiser). In embodiments in which the product display merchandiser 700 includes sidewalls that are removable, product can be stocked from the side (in addition to from above) (e.g., side loaded vs. top loaded).

Additionally, product display merchandisers that have removable sidewalls can be configured to have interchangeable sidewalls. For example, sidewalls that are different heights, different widths, made of different materials, different shapes, different colors, etc. may be useful for different products or uses. For example, product display merchandisers can be repurposed for different applications or products by changing the removable/interchangeable sidewalls.

General

This detailed description refers to specific examples in the drawings and illustrations. These examples are described in sufficient detail to enable those skilled in the art to practice the inventive subject matter. These examples also serve to illustrate how the inventive subject matter can be applied to various purposes or embodiments. Other embodiments are included within the inventive subject matter, as logical, mechanical, electrical, and other changes can be made to the example embodiments described herein. Features of various embodiments described herein, however essential to the example embodiments in which they are incorporated, do not limit the inventive subject matter as a whole, and any reference to the invention, its elements, operation, and application are not limiting as a whole, but serve only to define these example embodiments. This detailed description does not, therefore, limit embodiments of the invention, which are defined only by the appended claims. Each of the embodiments described herein are contemplated as falling within the inventive subject matter, which is set forth in the following claims.

The invention claimed is:

1. A product display comprising:

one or more arms;

a tray including one or more tracks receiving the one or more arms, respectively, wherein the tray is slidable along the one or more arms between a first position and a second position;

an engagement member;

a biasing mechanism for biasing products toward an end of the tray, wherein the biasing mechanism is operably connected to the engagement member, and wherein the engagement member automatically engages the biasing mechanism when the tray is displaced toward the second position;

a removable divider, wherein the removable divider is configured to be removably affixed to a top surface of the tray so as to divide the tray into multiple sections; and a removable divider holder configured to retain the removable divider entirely below a bottom surface of the tray, parallel to the bottom surface of the tray, in a manner such that the removable divider does not divide the tray into the multiple sections.

2. The product display of claim 1, wherein the one or more arms define right and left boundaries of an unobstructed opening when the tray is in the second position.

3. The product display of claim 2, wherein a rear portion of the tray defines a front boundary of the unobstructed opening when the tray is in the second position and a stabilizer defines a rear boundary of the unobstructed opening when the tray is in the second position.

4. The product display of claim 1, further comprising:

a handle operably connected to a first mating member, wherein the handle is coupled to the tray; and a second mating member on the one or more arms;

wherein the first mating member and the second mating member are complementary to one another.

5. The product display of claim 4, wherein displacement of the handle in a direction causes the first mating member to disengage from the second mating member.

6. The product display of claim 5, wherein disengagement of the first mating member from the second mating member allows the tray to travel in the direction to the second position.

7. The product display of claim 5, wherein the displacement of the handle in the direction is a rotational displacement that is substantially in the direction.

8. The product display of claim 4, wherein the first mating member engages the second mating member when the tray is in the first position, and wherein engagement of the first mating member with the second mating member resists movement of the tray from the first position to the second position.

9. The product display of claim 1, wherein the engagement member automatically disengages the biasing mechanism when the tray is displaced from the second position.

10. The product display of claim 1, further comprising:

a tray engagement member, wherein the tray engagement member resists movement of the tray from the second position to the first position while the tray is in the second position.

11. The product display of claim 1, further comprising a rear stabilizer.

12. The product display of claim 11, wherein the rear stabilizer is attached to the one or more arms, and wherein one of the rear stabilizer and the one or more arms include bracket engagement members configured to secure the product display to one or more mounting members.

13. The product display of claim 11, further comprising a front stabilizer.

14. The product display of claim 13, wherein the front stabilizer is attached to the one or more arms.

15. A product display comprising:

a tray;

a first sidewall;

a second sidewall, wherein one or both of the first sidewall and the second sidewall are removably attached to the tray;

a bracket engagement member coupled to a rear end of the product display, the bracket engagement member configured to support the product display from a bar or grid system;

a removable divider, wherein the removable divider is configured to be removably affixed to the tray between the first and second sidewalls so as to divide a product-supporting surface between the first and second sidewalls into multiple sections, each section defined between one of the first and second sidewalls and the removable divider; and a removable divider holder configured to hold the removable divider to an undersurface of the tray, parallel to the undersurface of the tray, in a manner such that the removable divider does not divide the tray into the multiple sections.

16. The product display of claim 15, wherein the tray has an outer portion which pairs with an outer portion of one of the first sidewall and the second sidewall.

17. The product display of claim 15, wherein the first sidewall and the second sidewall are removably attached to the tray via one or more of clips, snaps, hooks, engagement members, slots, recesses, protrusions, and apertures.

18. The product display of claim 15, further comprising:

a second product display including a bottom tray and a third sidewall, wherein the second product display is positioned adjacent to the product display such that product in the second product display is supported by the bottom tray, the third sidewall, and the first sidewall.

19. A product display comprising:

one or more arms;

a tray including one or more tracks receiving the one or more arms, wherein the tray is slidable along the one or more arms between a first position and a second position;

a removable divider, wherein the removable divider is configured to be removably affixed to the tray in an upright position so as to divide an upper surface of the tray into multiple sections; and a removable divider holder configured to retain the removable divider in a horizontal position entirely below a bottom surface of the tray such that the removable divider does not divide the tray into the multiple sections.

20. The product display of claim 19, wherein the removable divider holder comprises clips formed in the bottom surface of the tray.

* * * * *